US006201941B1

(12) United States Patent
Kasahara et al.

(10) Patent No.: US 6,201,941 B1
(45) Date of Patent: Mar. 13, 2001

(54) DEVELOPER CONTAINER FOR AN IMAGE FORMING APPARATUS AND METHOD OF CONVEYING A DEVELOPER

(75) Inventors: Nobuo Kasahara; Satoshi Muramatsu, both of Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/344,142

(22) Filed: Jun. 24, 1999

(30) Foreign Application Priority Data

| | | |
|---|---|---|
| Jun. 25, 1998 | (JP) | 10-179018 |
| Nov. 6, 1998 | (JP) | 10-316393 |
| Nov. 30, 1998 | (JP) | 10-340200 |
| Apr. 7, 1999 | (JP) | 11-100310 |
| Jun. 14, 1999 | (JP) | 11-167131 |

(51) Int. Cl.[7] ..... G03G 21/10; G03G 15/08

(52) U.S. Cl. ..... 399/258; 399/106; 399/256; 399/262

(58) Field of Search ..... 399/254, 256, 399/258, 260, 262, 265, 119, 120, 92, 93, 102, 103, 105, 106; 430/120; 222/DIG. 1, 167

(56) References Cited

U.S. PATENT DOCUMENTS

| | | | | |
|---|---|---|---|---|
| 4,984,023 | * | 1/1991 | Yoshida | 399/106 |
| 5,561,506 | * | 10/1996 | Kasahara | 399/256 |
| 5,740,507 | * | 4/1998 | Ichikawa et al. | 399/262 |
| 5,797,074 | * | 8/1998 | Kasahara et al. | 399/262 |
| 5,915,154 | * | 6/1999 | Schoch et al. | 399/258 |
| 5,950,055 | * | 9/1999 | Yahata et al. | 399/258 X |
| 5,953,567 | * | 9/1999 | Muramatsu et al. | 399/256 |
| 5,987,298 | * | 11/1999 | Muramatsu et al. | 399/260 X |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A developer replenishing device included in an image forming apparatus for replenishing a developer to a developing unit is disclosed and includes a developer container filled with the developer. An air pump feeds compressed air into the developer container to thereby fluidize the developer. A powder pump discharge the fluidized toner from the developer container by suction and delivers it to the developing unit. When the toner container is set on the body of the apparatus, an air feed portion penetrates into the container.

38 Claims, 23 Drawing Sheets

DEVELOPER CONTAINER FOR AN IMAGE FORMING APPARATUS AND METHOD OF CONVEYING A DEVELOPER

BACKGROUND OF THE INVENTION

The present invention relates to a developer replenishing device for a copier, facsimile apparatus, printer or similar electrophotogrpahic image forming apparatus. More particularly, the present invention relates to a develop container storing a developer, i.e., toner or a toner and carrier mixture and removably mounted to the body of the image forming apparatus, and a method of conveying the developer to the developing unit or similar preselected location.

It is common practice with an image forming apparatus to sense the toner content of a developer stored in a developing unit for maintaining it constant. A developer container storing a developer and implemented as, e.g., a bottle or a cartridge is located in or in the vicinity of a unit including the developing unit. The developer is replenished from the developer container to the developing unit either directly or via a toner hopper.

Because the developer is replenished to and consumed by the developing unit, the developer container is replaced at an adequate time. The replacement of the developer container is one of awkward operations to perform. Various implementations have heretofore been proposed to promote easy replacement of the developer container. For example, a toner bottle may be positioned on a support member and automatically opened when the support member is returned to a preselected position. The developer container may be implemented as a flexible sack and set in the developing unit. When the sack in its open position is emptied, it is compressed and left in the apparatus body.

However, the problem with the above toner bottle scheme is that it needs a sophisticated, expensive mechanism and is applicable only to high-class image forming apparatuses. The flexible sack scheme needs an extra space for storing the compressed sacks. Moreover, because toner is replenished into the developing unit due to its own weight when the sack is opened, the sack must be positioned above the developing unit.

The conventional toner container in the form of a hard cartridge or a hard bottle has another problem left unsolved as to disposal after replacement. Specifically, it has been customary for a manufacturer to collect used toner containers form users' stations and recycle, reuse or burn them up. The hard cartridges or bottles are bulky and increase the circulation cost up to collection.

There has been proposed a developer container whose volume can be reduced. With this kind of developer container, however, a developer cannot be stably replenished to the developing unit. Even if the volume of the developer container can be reduced only during transport, the developer is apt to bring about contamination at the time of transfer.

On the other hand, the developer is often conveyed from the developer container to the developing unit by a screw, paddle or similar mechanical auger means. A drawback with the mechanical auger means is that the screw for conveying the developer must be substantially linearly arranged. Therefore, the developer container and developer replenishing device must be constructed integrally with or located in close proximity to the developing unit. As a result, the developer replenishing device is sophisticated and expensive, lowers productivity, obstructs maintenance, and makes it difficult to maintain the property or quality of the toner. In addition, the developer container is difficult to replace.

Japanese Patent Laid-Open Publication No. 7-219329, for example, proposes to convey toner together with air via a flexible tube by use of a screw pump and air feeding means. The screw pump includes a rotor rotatable to move toner, or developer, in the axial direction, and a stator surrounding and contacting the rotor. The air feeding means feeds air under pressure for fluidizing the developer being moved by the screw pump.

The convey system using the above screw pump is capable of surely conveying the developer via the flexible tube and therefore with a simple configuration without regard to the location of a toner storing section or that of a toner collecting section. Further, the compressed air fluidizes the developer for promoting stable conveyance of the developer and frees the developer from mechanical stresses that would bring about blocking or bridging. However, the screw pump essential with this system increases the cost.

Technologies relating to the present invention are also disclosed in, e.g., Japanese Patent Laid-Open Publication Nos. 6-59572, 7-306576, 8-211718 and 11-52695 and Japanese Patent No. 2,677,575.

SUMMARY OF THE INVENTION

It is therefore an object of the present invention to provide a method capable of conveying a developer without restoring to a screw pump while protecting it from stresses, and an image forming apparatus for practicing the same.

It is another object of the present invention to provide a method practicable with a flexible developer container and capable of directly replenishing a developer from the container to a developing unit, and an image forming apparatus for practicing the same.

It is a further object of the present invention to provide a developer container capable of being located at any suitable position, easy to replace, simple in configuration and low cost, and an image forming apparatus using the same.

In accordance with the present invention, a method of conveying a developer stored in a developer container to a preselected location includes the steps of feeding compressed air into the developer container to thereby fluidize the developer, and conveying the fluidized developer to the preselected location.

Also, in accordance with the present invention, an image forming apparatus capable of fluidizing a developer and then conveying it to a preselected location includes a developer container storing the developer, and an air feeding device for feeding compressed air into the developer container for fluidizing the developer.

BRIEF DESCRIPTION OF THE DRAWINGS

The above and other objects, features and advantages of the present invention will become more apparent from he following detailed description taken with the accompanying drawings in which.

DESCRIPTION OF THE PREFERRED EMBODIMENTS

Preferred embodiments of the present invention will be described hereinafter. While the same reference numbers are used in the embodiments to be described, they do not always designate the same structural elements. A construction and operation common to the illustrative embodiments will not be repeatedly described in order to avoid redundancy.

First Embodiment

Figure 1:
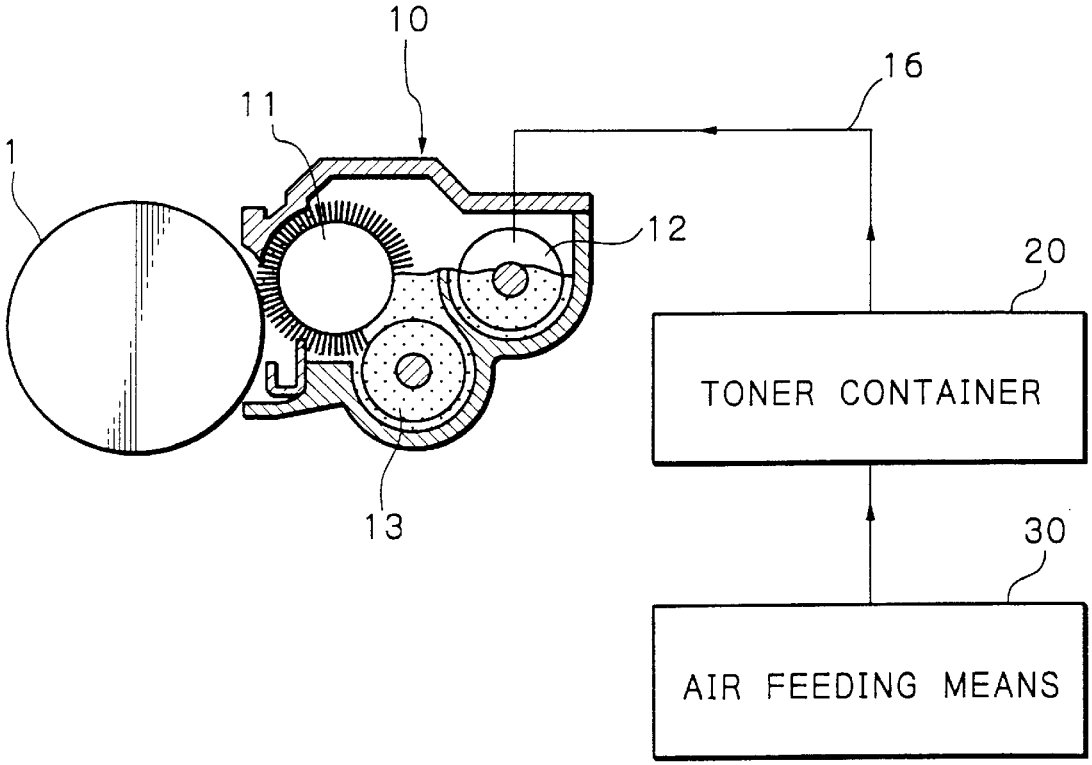
FIG. 1 is a block diagram schematically showing a first embodiment of the developer replenishing device in accordance with the present invention.
Figure 2:
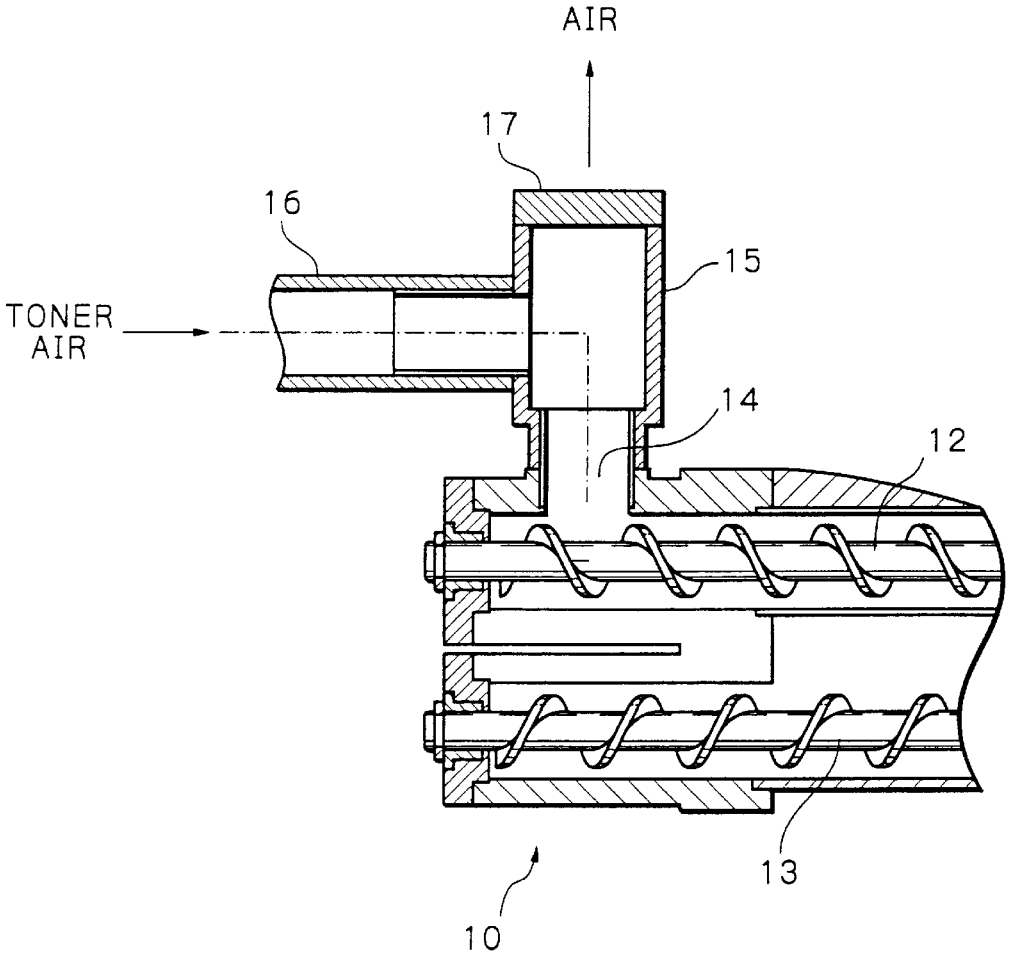
FIG. 2 is a sectional view showing a toner inlet portion included in a developing unit.

FIG. 1 shows a developer replenishing device implemented by a developer conveying method embodying the present invention. FIG. 2 shows a part of a developing unit to which a developer is replenished by the conveying method. As shown in FIG. 1, a developer replenishing device replenishes a developer, i.e., toner to a developing unit 10. The developer replenishing device includes a toner container 20 filled with toner and air feeding means 30. The air feeding means 30 feeds air under pressure for conveying the toner from the toner container 20 to the developing unit 10.

As shown in FIGS. 1 and 2, the developing unit 10 includes a developing sleeve 11 facing a photoconductive drum or image carrier 1 and a first and second screw 12 and 13, respectively. The screws 12 and 13 are used agitate a developer stored in the developing unit 10. Specifically, the first screw 12 conveys the developer rightward, as seen in FIG. 2, while the second screw 13 conveys it leftward, as seen in FIG. 2. While the developer is so circulated by the screws 12 and 13, it is deposited on the developing sleeve 11 for developing a latent image electrostatically formed on the drum 1.

As shown in FIG. 2, the developing unit 10 includes a toner inlet portion 14 facing the first screw 12 in the vicinity of the front end of the unit 10. A connecting member 15 is mounted on the edge of the toner inlet 14. A flexible tube or conveying member 16 is removably fitted on the connecting member 15. When a toner and air mixture is fed under pressure into the connecting member 15, an air filter 17 positioned in them ember 15 discharges only air therethrough so as to prevent the toner from flying out of the developing unit 10. It is to be noted that the toner may be replenished in to the developing unit 10 at any desired position. Also, the developing unit 10 may have an suitable configuration other than one shown in FIGS. 1 and 2.

The toner container 20 is a unit independent of the developing unit 10 and removably mounted to the body of an image forming apparatus in a preselected position. The toner container 20 is communicated to the developing unit 10 by the flexible tube 16. The tube 16 has a diameter, e.g., 4 mm to 10 mm and is advantageously formed of rubber resistant to the toner, e.g., polyurethane rubber, nitril, rubber, EPDM (Ethylene-Propylene-Dien Terpolymer) rubber or silicone rubber. The tube 16 can therefore be laid in any desired direction.

Figure 3:
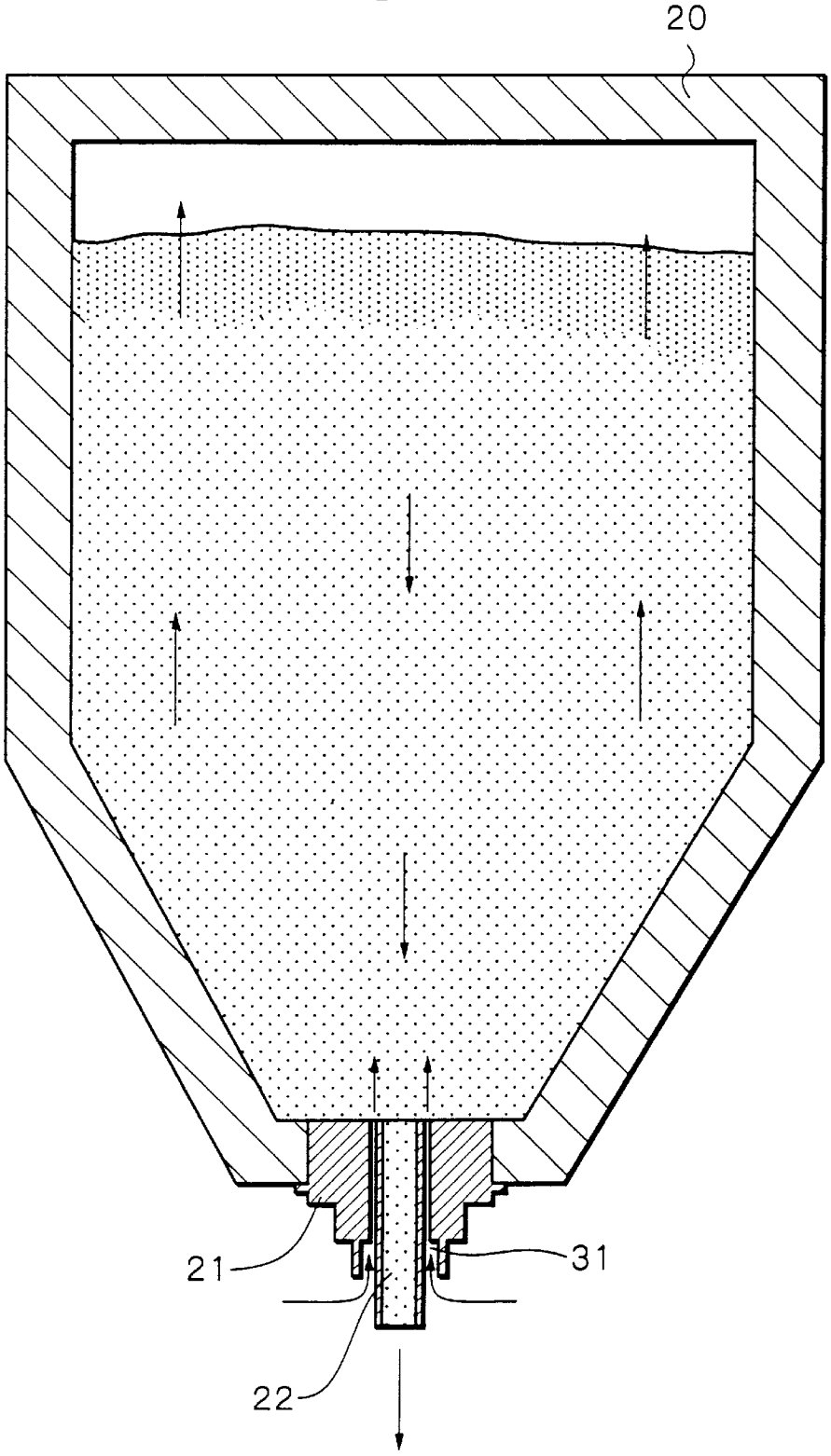
FIG. 3 is a sectional view showing a toner container representative of a developer container included in the first embodiment.

FIG. 3 shows the toner container or developer container. As shown, the toner container, labeled 20, is implemented as a sack and has a connecting member 21 fitted on one end thereof. A discharge pipe or discharge portion 22 is received in a hole formed in the connecting member 21, as illustrated. In the illustrative embodiment, the hole of the connecting member 21 has an inside diameter greater than the outside diameter of the discharge tube 22, so that a gap 31 is formed between the hole and the tube 22. The gap 31 allows compressed air to flow into the toner container 21, as will be described specifically later. An air pump, not shown, is communicated to the gap 31.

The toner container or sack 20 is formed or polyethylene, nylon or similar resin. Specifically, the container 20 is implemented by a single sheet having a thickness of about 80 $\mu$m to 120 $\mu$m or a laminate of such sheets having their edges connected by, e.g., ultrasonic wave. Aluminum may advantageously be deposited on the surface of the sheet or each sheet from the static electricity standpoint. The connecting member 21 may also be formed of polyethylene, nylon or similar resin so as to promote recycling.

The toner container 20 is set on the image forming apparatus in the position shown in FIG. 3. In this position, toner stored in the toner container 20 accumulates in the lower portion of the container 20. The discharge tube 22 is directly communicated to the above portion of the toner container 20 without the intermediary of an air layer. Compressed air fed from the air pump flows via the gap 31 into the lower portion of the toner container 20 where the toner accumulates. In the illustrative embodiment, the air pump and gap 31 constitute air feeding means. If desired, the gap 31 may be replaced with an air feed pipe arranged in a double wall structure together wit the discharge pipe 22 or fitted in the connecting member 21 in parallel with the discharge pipe 22.

In operation, when the air pump is energized by a toner replenish signal, it sends compressed air into the toner container 20 via the gap 31. Because the compressed air jets into the toner container 20 via the bottom of the container 20, it scatters and fluidizes the toner layer existing tin the container 20 while flowing upward. The continuous feed of the compressed air raises air pressure inside the toner container 20. As a result, the toner is discharged from the toner container 20 due to the air pressure and its own weight. The toner discharged from the toner container 20 is conveyed to the developing unit 10 together with air.

As stated above, the toner stored in the toner container 20 is transferred to the developing unit 10 by air pressure. Air jetting into the toner container 20 fluidizes the toner and thereby promotes the smooth, sure conveyance of the toner. In addition, the toner container 20 is funnel-shaped tapered toward the discharge pipe 22, allowing substantially the entire toner to be discharged.

The toner container 20 is constantly filled with air an therefore free from folds or creases, so that the inner wall of the container 20 exerts a minimum of frictional resistance. Further, the toner being transferred by the air pressure is free from mechanical stresses and is protected from blocking or bridging because of sufficient fluidity. Moreover, the toner transfer using the air pressure maintains the physical property of the toner stable without regard to the amount of toner existing in the toner container 20 and allows the entire toner to be discharged from the container 20.

Figure 4:
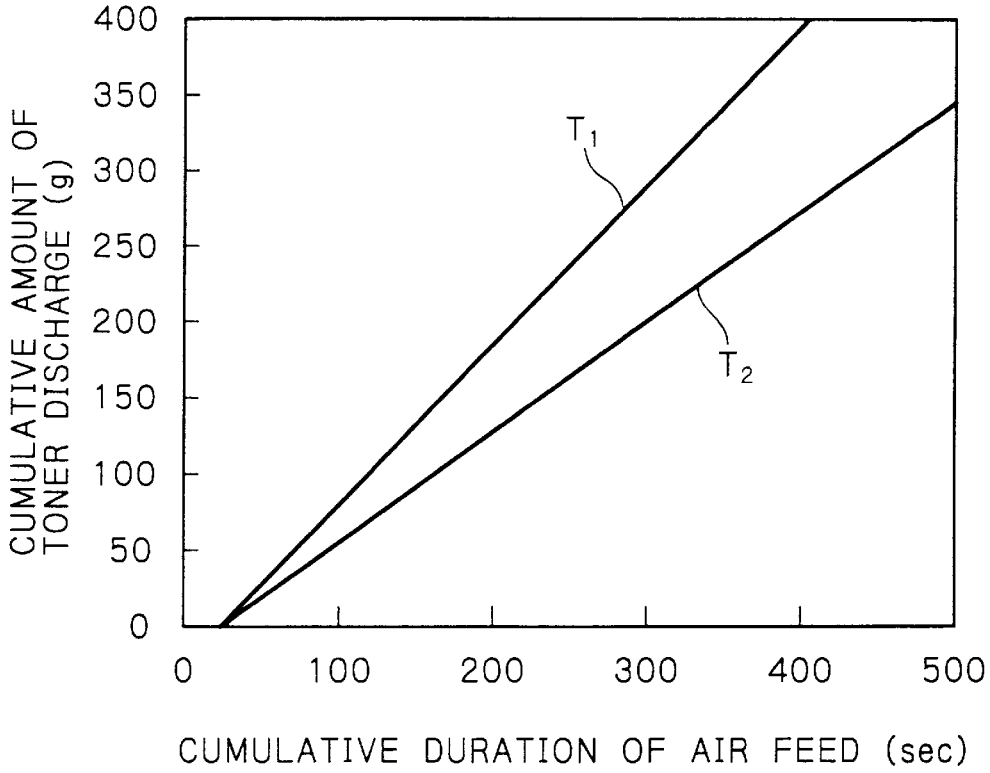
FIG. 4 is a graph showing experimental results obtained with the toner container of FIG. 3.

FIG. 4 is a graph showing experimental results obtained with the toner container 20 shown in FIG. 3. In FIG. 4, the ordinate and abscissa respectively indicate the cumulative amount of toner discharged from the container 20 and the cumulative time over which the compressed air is fed into the container 20. For tests, use was made of an air pump having the maximum static pressure of 18 Kpa and the maximum flow rate of 1.91 l/min. The container 20 was implemented as a 100 nm thick sack formed of polyethylene. The discharge pipe 22 had a diameter of 6 mm. Tests were conducted at a temperature of 25° C. and a humidity of 60%. There were used two different types of toner $T_1$ and $T_2$ which were respectively color toner type F and PPC toner type 8200 both of which are available form Ricoh Co., Ltd.

As FIG. 4 indicates, both of the toner $T_1$ and $T_2$ were stably discharged in an mount proportional to the duration of air feed. It was also found that the amount of toner to be discharged could be controlled by controlling the duration of operation of the air pump.

It will be sen from the above that the illustrative embodiment can replenish the toner only if the air pump is ON/OFF controlled. The embodiment is therefore extremely simple, compact, and low cost. Further, because the embodiment does not need any valve in its toner transfer path, it insures stable toner transfer and highly durable.

Figure 5:
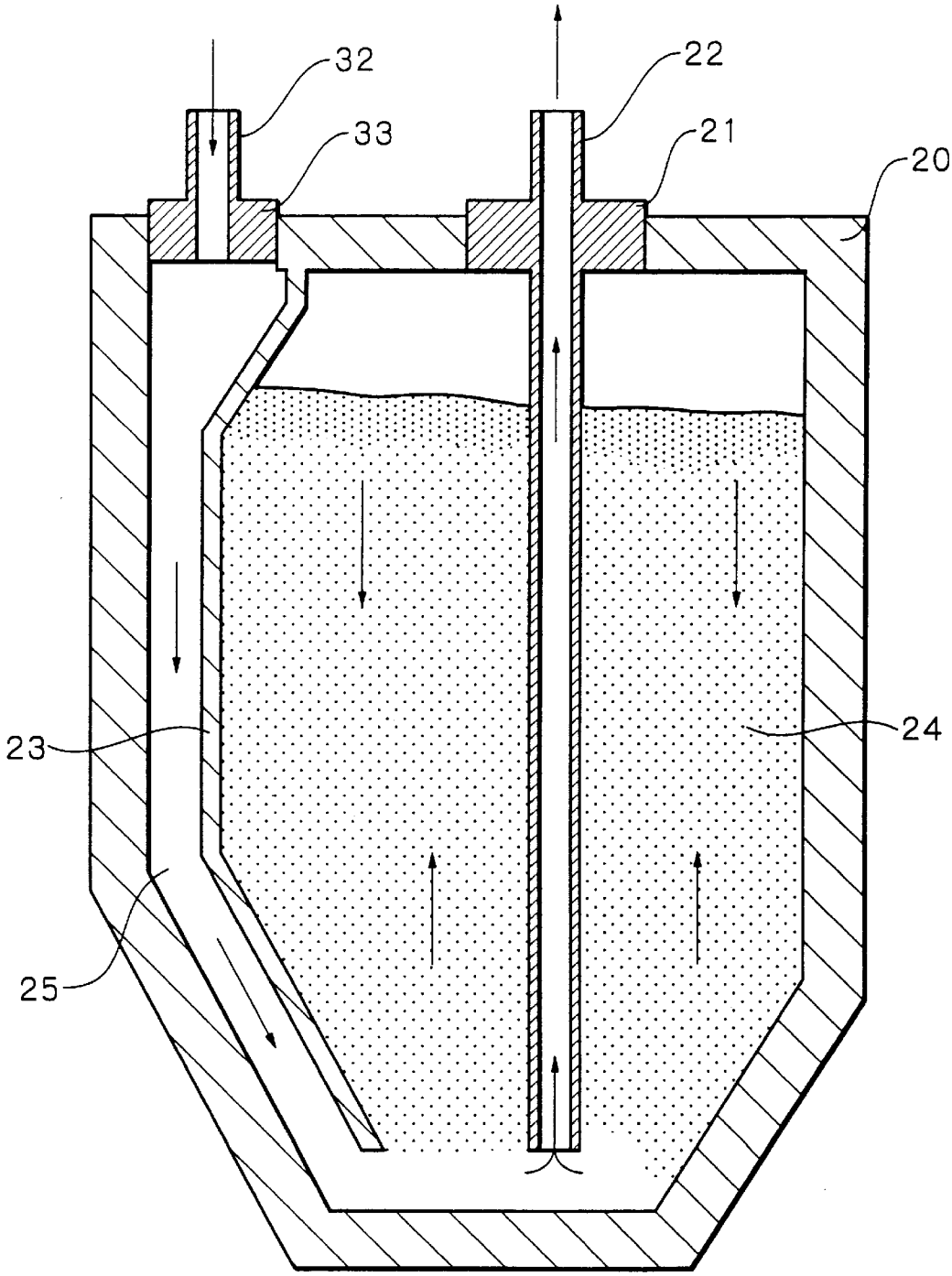
FIG. 5 is a sectional view showing a modification of the toner container of the first embodiment.

FIG. 5 shows a modified form of the toner container 20. As shown, the toner container or sack 20 has a toner chamber 24 and an air chamber 25 separated by a wall or partition 23. The wall 23 extends from the tope of the container 20 to a position adjoining, but short of, the bottom of the container 20, so that the two chambers 24 and 25 are communicated to each other at the bottom of the container 20. The connecting member 21 and a connecting member 33 are respectively fitted in the upper end of the toner chamber 24 and that of the air chamber 25. The discharge pipe 22 and an air feed pipe 32 are affixed to the connecting members 21 and 33, respectively. As for the material and configuration, the container 20 is identical with the container 20 shown in FIG. 3.

The above toner container 20 is set on the image forming apparatus in the position shown in FIG. 5. In this position, toner stored in the toner container 20 accumulates in the lower portion of the container 20. In the modification, while one end of the discharge pipe 22 is positioned outside of the container, the other end is positioned in the vicinity of the bottom of the container 20, as illustrated. The air feed pipe 32 fitted in the connecting member 33 does not protrude into the air chamber 25. The tube 16, not shown, is connected to the outer end of the discharge pipe 22.

In operation, when the air pump is energized by a toner replenish signal, it sends compressed air into the air chamber 25 of the toner container 20 via the air feed pipe 32. Because the compressed air jets into the toner container 20 in the vicinity of the bottom of the container 20, it scatters and fluidizes the toner layer existing in the container 20 while flowing upward. The continuous feed of the compressed air raises air pressure inside the toner container 20. As a result, the toner is discharged form the toner container 20 via the discharge pipe 22 due to the air pressure. The toner discharged from the toner container 20 is conveyed to the developing unit 10 together with air.

The toner container 20 shown in FIG. 5 also achieves the advantages described in relation to the toner container 20 shown in FIG. 3.

Figure 6:
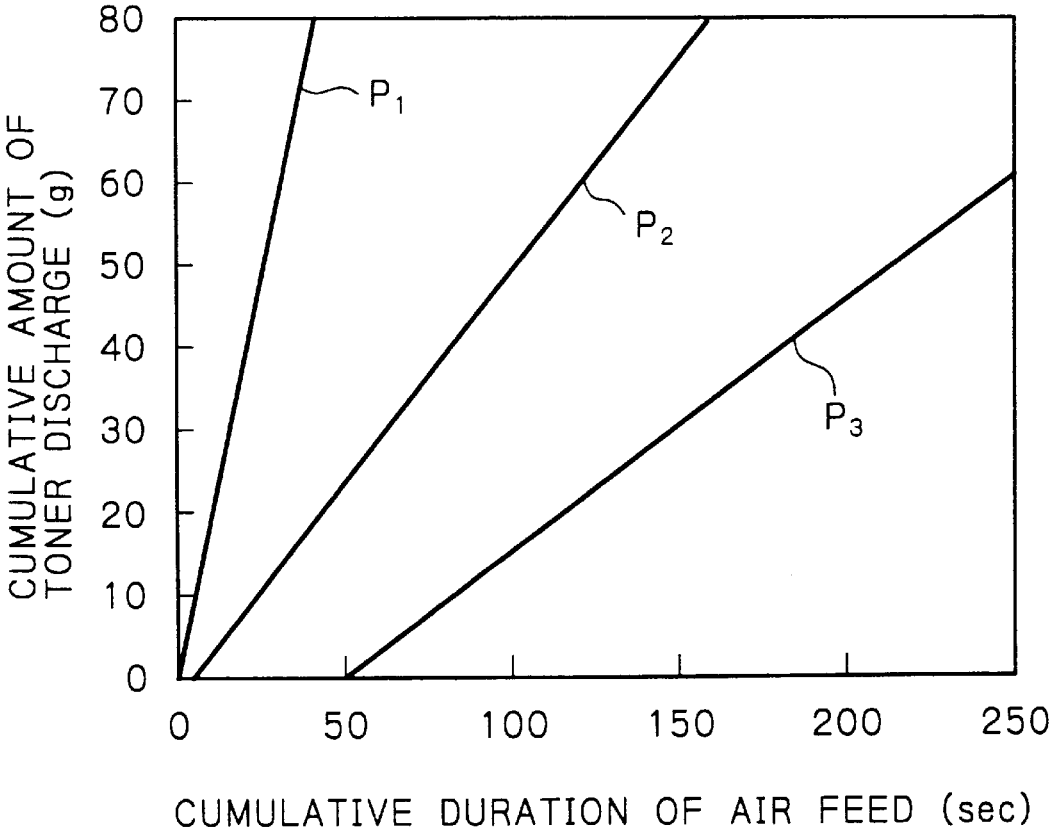
FIG. 6 is a graph showing experimental results obtained with the toner container of FIG. 5.

FIG. 6 is a graph showing experimental results obtained with the toner container 20 shown in FIG. 5. In FIG. 5, the ordinate and abscissa respectively indicate the cumulative amount of toner discharged from the container 20 and the cumulative time over which the compressed air is fed into the container 20. For tests, there were used an air pump $P_1$ having the maximum static pressure of 50 Kpa and the maximum flow rate of 2.0 l/min, an air pump $P_2$having the maximum static pressure of 35 Kpa and the maximum flow rate of 2.0 l/min, and air pump $P_2$ having the maximum static pressure of 18 Kpa and the maximum flow rate of 1.9 l/min. The container 20 was implemented as a 100 nm thick sack formed of polyethylene. The discharge pipe 22 had a diameter of 6 mm. Tests were conducted at a temperature of 25° C. and a humidity of 60%. As for toner, use was made of PPC toner type 8200 mentioned earlier.

As FIG. 6 indicates, all the pumps $P_1$–$P_3$ caused the toner to be discharged in an amount proportional to the duration of air feed and thereby stabilized the toner discharge. In addition, the amount of toner discharge for a unit period of time was dependent on the maximum static pressure of the air pump.

It will be seen from the above that the toner replenishing device can replenish the toner only if the air pump is ON/OFF controlled. The device is therefore extremely simple, compact, and low cost. Further, because the device does not need any valve in its toner transfer path, it insures stable toner transfer and highly durable.

In the illustrative embodiment and its modification, an electric outlet, a power source, switches and a control circuit, not shown, are used to controllably drive a motor and the air pump with any conventional technology.

The time for driving the pump and the time for feeding compressed air are important factors for the reliable replenishment of the toner. Specifically, the prerequisite is that compressed air begins to be fed before the drive of the pump and continuously fed throughout the drive of the pump and, more preferably, after the stop of the drive of the pump. This is successful to prevent the toner from remaining in the conveying members including the tube and therefore to insure stable toner replenishment.

While the compressed air may be fed into the toner container 20 at the same time as it is fed to the pump, the feed of air into the container 20 may be synchronized with the toner replenish signal or effected intermittently.

Generally, toner for use in an electrophotographic image forming apparatus is difficult to convey due to its extremely low fluidity, as well known in the art. The toner to be conveyed should be protected from heavy mechanical stresses that would bring about blocking and cracking. Such an occurrence would not only change the property of the toner and obstruct conveyance, but also damage conveying members (coils, screws, pipes, etc.) and drive members.

The auger and pipe included in the conventional toner replenishing device cause an extremely heavy mechanical stress to act on the toner due to friction between the auger and the pipe. This problem becomes more serious as the distance of conveyance increases or as the direction of conveyance changes more. Further, a torque necessary for driving the auger increases and increases the cost of the drive members while aggravating power consumption.

For the above reasons, the conventional toner replenishing device cannot have its distance of conveyance increased or its direction of conveyance changed without a plurality of augers and plurality of pipes connected in multiple stages. This further changes the property of the toner, increases the number of parts and cost, aggravates the fall of reliability, obstructs maintenance, degrades productivity, increases a space to be all located to the device, and lowers manipulability.

In the illustrative embodiment and its modification, the flexible pipe for toner transfer should only be connected to the developing unit 10. This prevents the toner from flying about and therefore insures safety operation. In addition, the toner replenishing device can be located at any desired position relative to the developing unit, e.g., a position where the toner container can be replaced most easily.

The flexible toner container or sack 20 is not bulky, compared the conventional hard cartridge or bottle, and is easy to handle at the time of transport or storage while needing a minimum of space. When the toner container 20 is collected from the user's station to be recycled, reused or burned up, it can be folded up due to its flexibility. This not only further enhances the above advantages, but also noticeably reduces the circulation cost from the user's station to, e.g., the recycling cite.

The toner container included in the illustrative embodiment may, of course, store a toner and carrier mixture in place of toner. The construction of the developing unit shown and described is, of course, only illustrative.

As stated above, the above embodiment has the following advantages (1)–(9).

(1) The toner replenishing device fluidizes the developer stored in the container so as to promote easy conveyance of the toner to a preselected location outside of the container.

(2) The developer can be conveyed from the container to the preselected section by air pressure.

(3) The arrangement for conveying the developer to the preselected section is simple and low cost.

(4) The developer can be surely fluidized and easily controlled in amount.

(5) The developer is prevented from flying about despite compressed air used for conveyance.

(6) The container is foldable and reduces, e.g., recycling cost.

(7) A minimum of developer is allowed to remain in the container.

(8) A single connecting member suffices both the feed of air into the container and the discharge of the developer from the container. The container with such a single connecting member is easy to recycle.

(9) The container can be located at any desired position.

Second Embodiment

Figure 7:
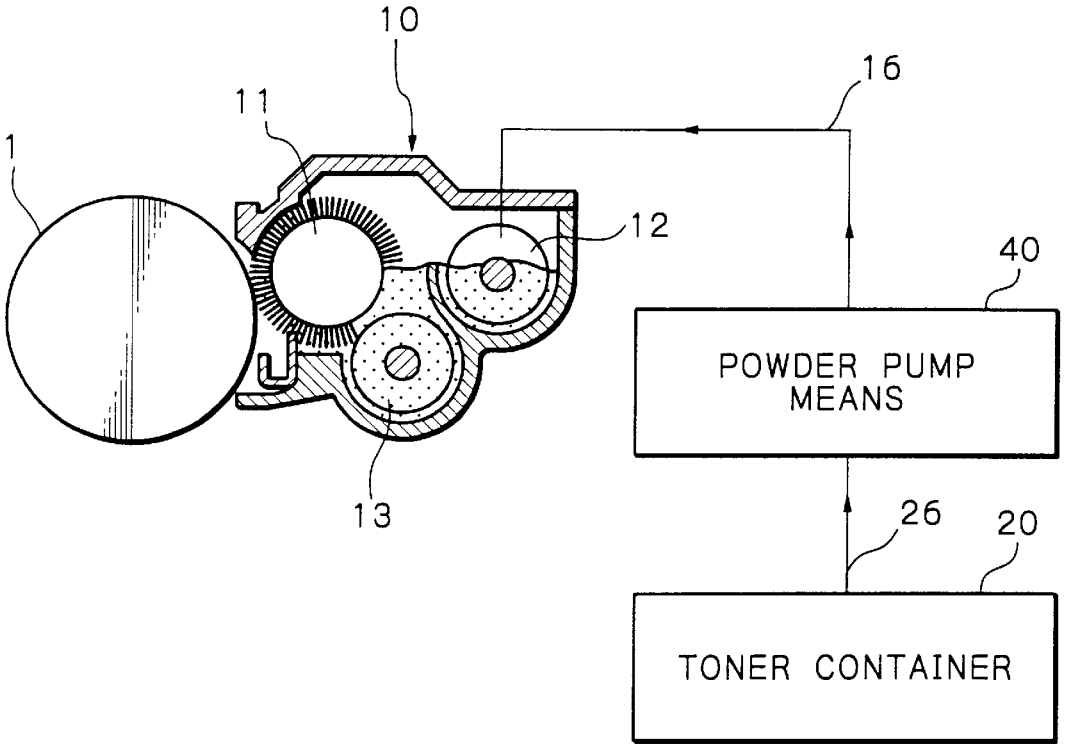
FIG. 7 is a schematic block diagram showing a second embodiment of the developer replenishing device in accordance with the present invention.

An alternative embodiment of the present invention will be descried with reference to FIG. 7. As shown, a toner replenishing device replenishes toner, or developer, stored in the toner container 20 to the developing unit 10, as in the previous embodiment. The toner replenishing device includes means for discharging the toner from the toner container 20 and conveying it to the developing unit 10, i.e., powder pump means 40. The powder pump means 40 bifunctions as means for discharging the toner from the toner container 20 by suction and means for conveying it to the developing unit 10. The developing unit 10 is substantially identical in configuration with the developing unit 10 of the first embodiment.

Figure 8A:
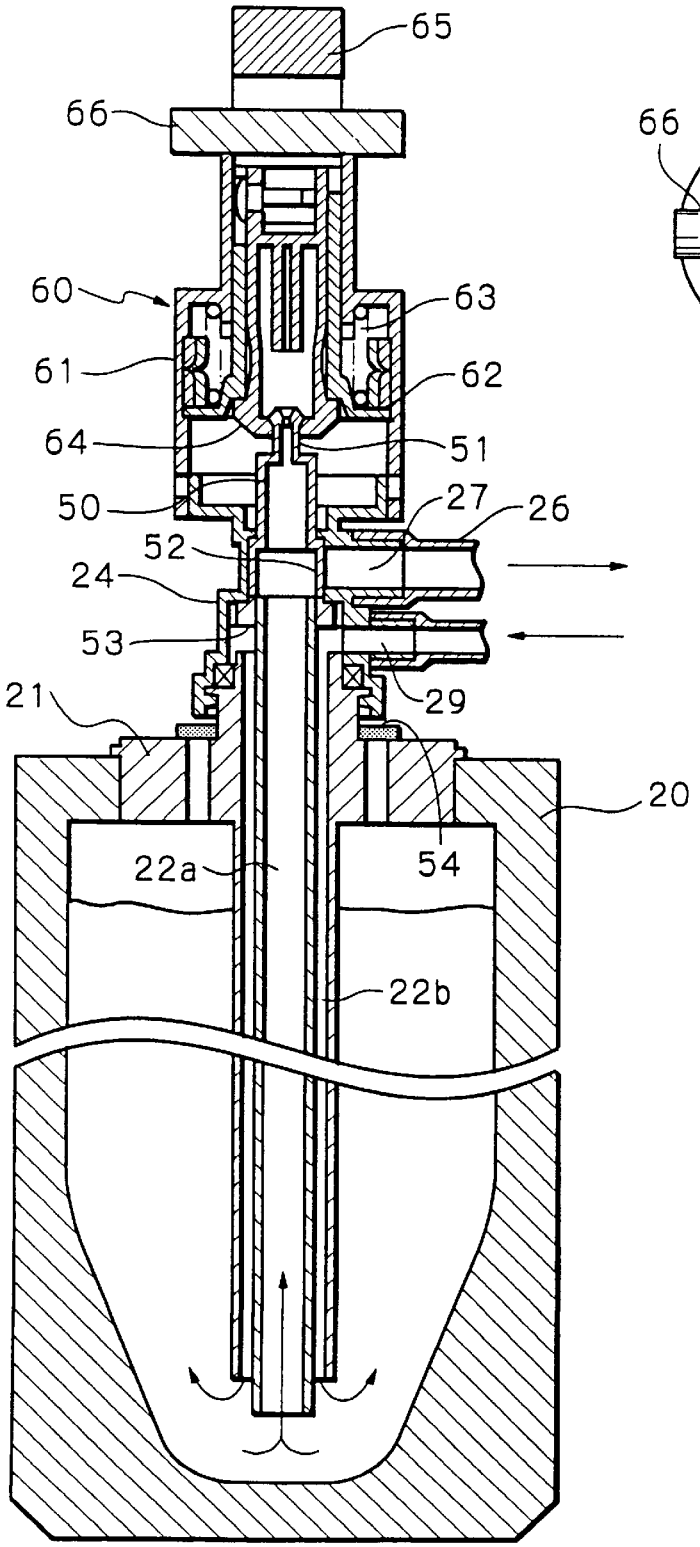
FIGS. 8A and 8B are respectively an enlarged sectional view and a plan view showing a developer container of the second embodiment in a condition wherein a lid member is opened.
Figure 8B:
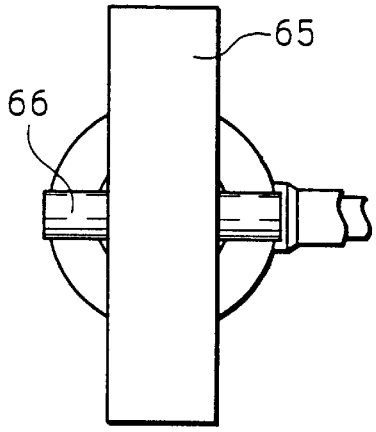
Figure 9A:
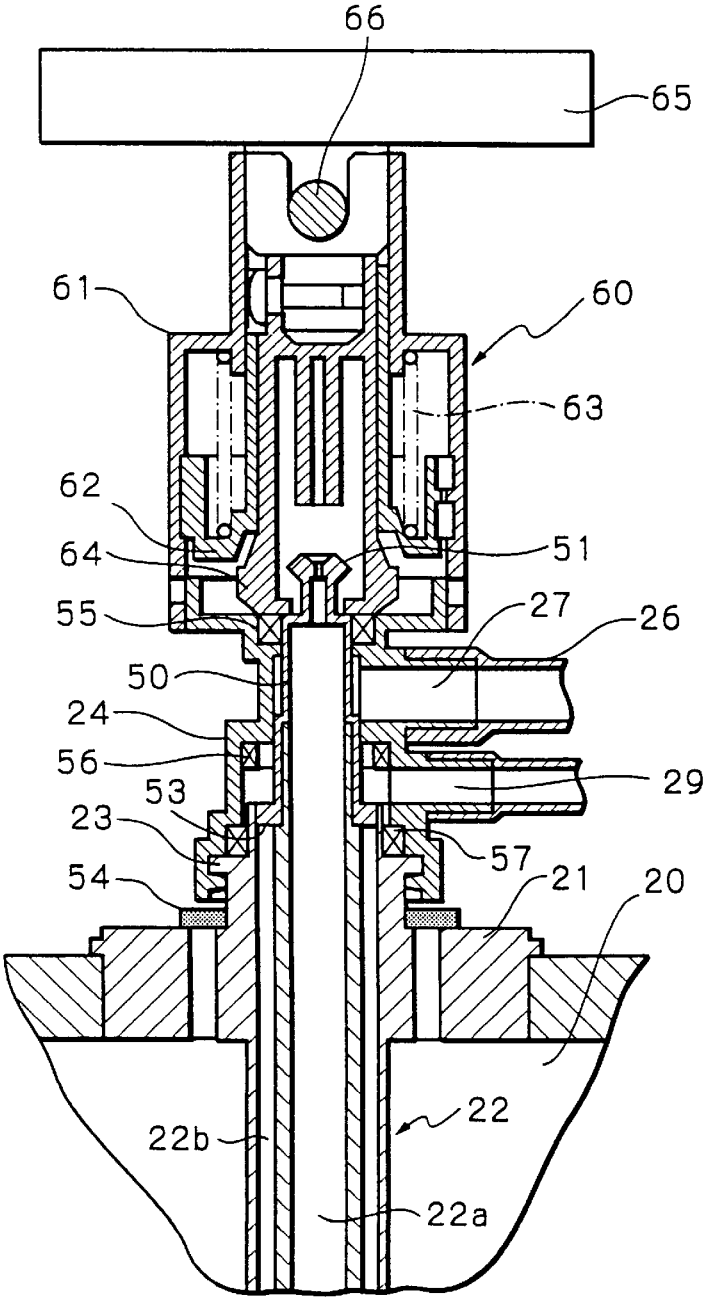
FIGS. 9A and 9B are respectively an enlarged sectional view and a plan view showing the developer container in a condition wherein the lid member is closed.
Figure 9B:
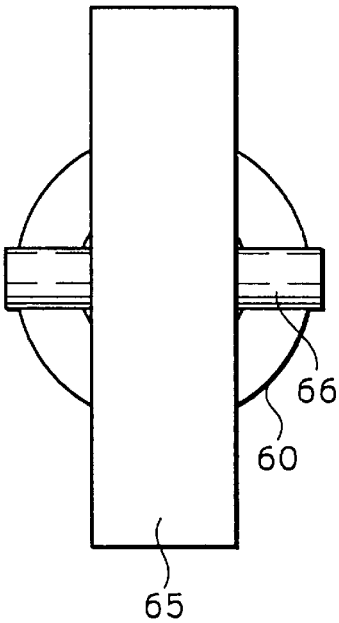

As shown in FIGS. 8A and 8B, the toner container 20 is also implemented as a sack. A support member 21 supports a cyclindrical member 222 formed with a toner outlet 22*a* and air inlet 22*b*. The support member 21 is soldered to the center of the upper end of the toner container 20 by, e.g., ultrasonic wave. As also shown in FIGS. 9A and 9B, the cylindrical member 222 is made up of two substantially concentric hollow cylinders each having a particular diameter. The inner cylinder forms a toner outlet passage 22*a* there inside while the inner cylinder and outer cylinder form an air inlet passage 22*b* therebetween. The lower end off the cylindrical member is positioned in the vicinity of the bottom of the toner container 20 while the upper end protrudes from the tope of the container 20.

A part 23 of the support member 21 located outside of the toner container 20 is screw-threaded. A mouth member 224 is fitted on the threaded part 223 of the support member 221 and formed with a toner inlet 27 communicable to the toner outlet passage 22*a*. A tube 26 is connected at one end thereof to the toner inlet 27 and connected at the other end to the suction port of the powder pump means 40.

Figure 10:
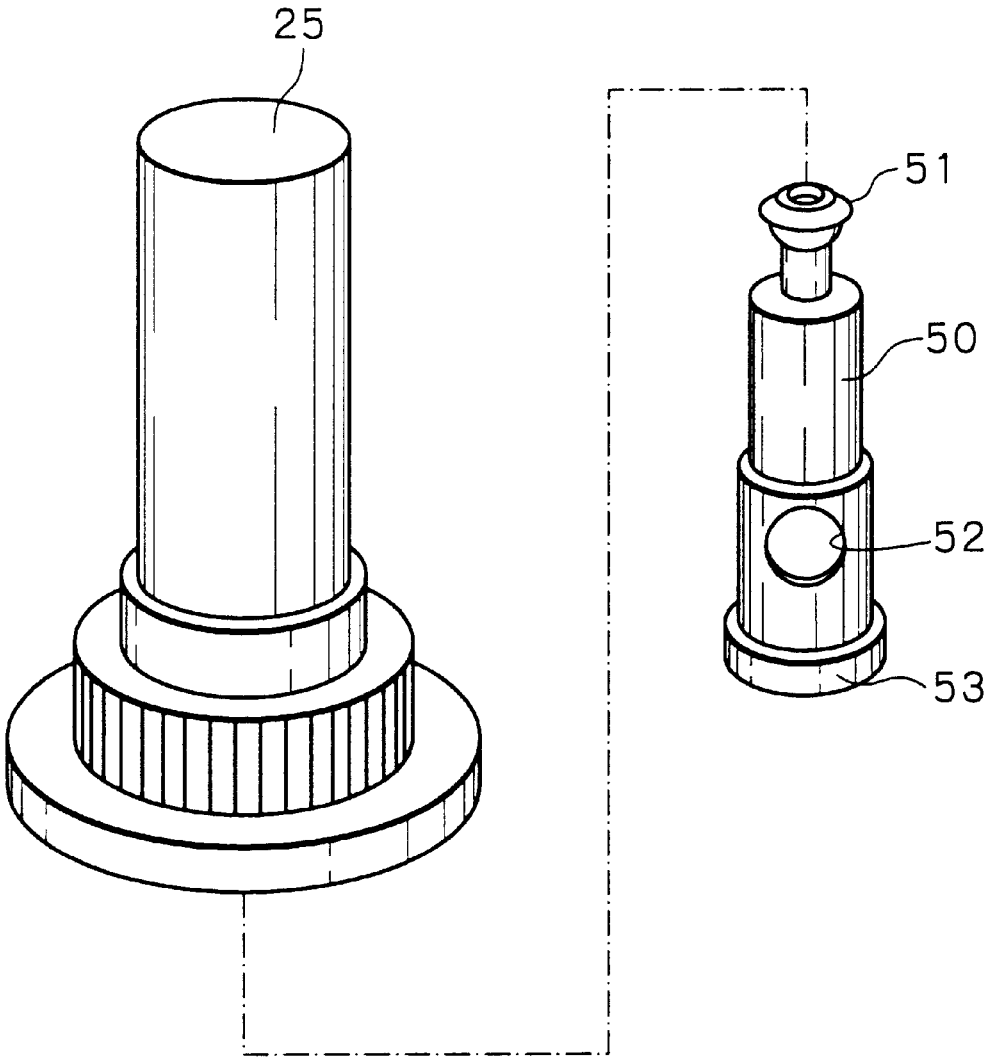
FIG. 10 is a perspective view of the lid member and a cap included in the toner container.

A lid member 50 is fitted on the cylindrical member 22 so as to usually close the two passages 22*a* and 22*b*. As shown in FIG. 10, the lid member 50 has a small shoulder or stepped portion at its intermediate portion. A lug 51 protrudes from the top of the lid member 50. An opening 52 is formed in the wall of the lower portion of the lid member 50 contiguous with the upper portion with the intermediary of the above shoulder. A flange 53 having a preselected thickness is formed at the bottom of the lid member 50. In the illustrative embodiment, the cylindrical member 222 constitutes a nozzle for discharging the toner stored in the toner container 20.

The toner container 20 is a unit independent of the developing unit 10 and can be located at any desired position on the body of the image forming apparatus. Specifically, the toner container 20 may be disposed in the apparatus body or positioned on the outside wall of the apparatus body. The powder pump means 40 intervenes between the toner container 20 and the developing unit 10. As shown in FIG. 7, the powder pump means 40 is communicated to the developing unit 10 by a tube or conveying member 16 and communicated to the toner container 20 by a tube or another conveying member 26.

Figure 11:
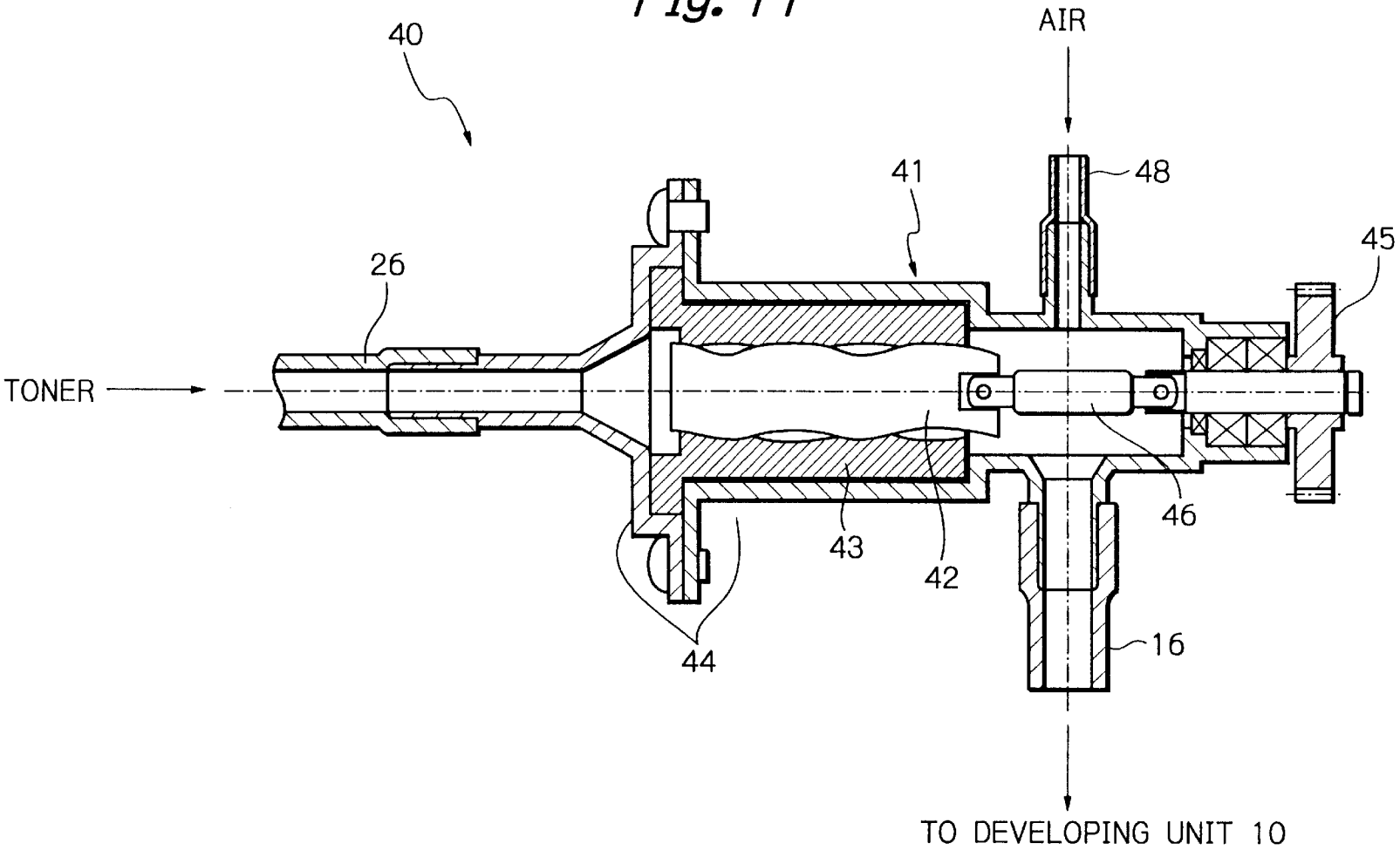
FIG. 11 is a sectional view showing toner or developer conveying means included in the second embodiment.

As shown in FIG. 11 in a sectional view, the powder pump means 40 includes a conventional suction type single axis, eccentric powder pump 41 generally referred to as a Morno pump. The powder pump 41 is generally made up of an eccentric screw-shaped rotor 42 formed of metal or similar rigid material, a double screw-threaded type stator 43 formed of rubber or similar elastic material, and a holder 44 surrounding the rotor 42 and stator 43 and formed of resin or similar material. The stator 43 is affixed to the holder 44. A drive source, not shown, cases the rotor 42 to rotate via a gear 45 and a joint 46.

When the rotor 42 is rotated by the drive source, the powder pump 41 generates an intense sucking force and thereby sucks the toner via the suction port formed in the end of the holder 44. The toner sucked into the powder pump 41 is discharged via an outlet port adjoining the joint 46. An air pump, not shown in FIG. 10, sends compressed air to the powder pump means 40 via a tube 48. The compressed air increased the fluidity of the toner and allows the powder pump 41 to surely convey the toner. Torque output from an exclusive motor assigned to the powder pump 41 or from a main motor included in the image forming apparatus is transmitted to the gear 45 via a clutch, although not shown specifically in FIG. 10.

The powder pump 41 is capable of continuously conveying the toner at a constant rate with a high solid-to-gas ratio in proportion to the rotation speed of the rotor 42, as well known in the art. It is therefore possible to control the amount of toner to be conveyed by controlling the duration of drive of the powder pump 41. The tubes 16 and 26 each are flexible and have a diameter of 4 mm to 10 mm. The tubes 16 and 26 may advantageously be formed of rubber resistant to the toner, e.g., polyurethane rubber, nitril rubber, EPOM rubber or silicone rubber. Such flexible tubes 16 and 26 are capable of conveying the toner even to a high lace and in any desired direction, i.e., upward, downward, rightward or leftward. In addition, the powder pump 41 frees the toner from stresses during conveyance and is therefore extremely advantageous for toner conveyance. It is to be noted that the powder pump means 40 should preferably be constructed into a unit for facilitating production and maintenance.

Because the toner for electrophotography lacks fluidity, as stated earlier, the toner container 20 is positioned upright with the bottom of the cylindrical member 222 adjoining the bottom of the container 20. The powder pump 41 sucks the toner via the end of the toner outlet passage 22*a* formed in the inner cylinder of the cylindrical member 222. When the lid member 50 is shifted, as will be described later, an air inlet 29 formed in the mouth member 54 is brought into communication with the air inlet passage 22*b*. In this condition, the air pump, not shown, sends compressed air to the air inlet 29. The compressed air fluidizes the toner stored in the toner container 20. This allows the powder pump 41 to surely discharge the toner from the toner container 20 by suction. A passage is formed in the support member 221 for releasing the compressed air flown into the toner container 20 and is covered with a filter 54.

Again, the toner container or sack 20 is formed or polyethylene, nylon or similar resin. Specifically, the container 20 is implemented by a single sheet having a thickeness of about 80 $\mu$m to 120 $\mu$m or a laminate of such sheets having their edges connected by, e.g., ultrasonic wave. Aluminum may advantageously be deposited on the surface of the sheet or each sheet from the static electricity standpoint. The cylindrical member 222 may also be formed of polyethylene, nylon or similar resin so as to promote recycling.

Figure 12:
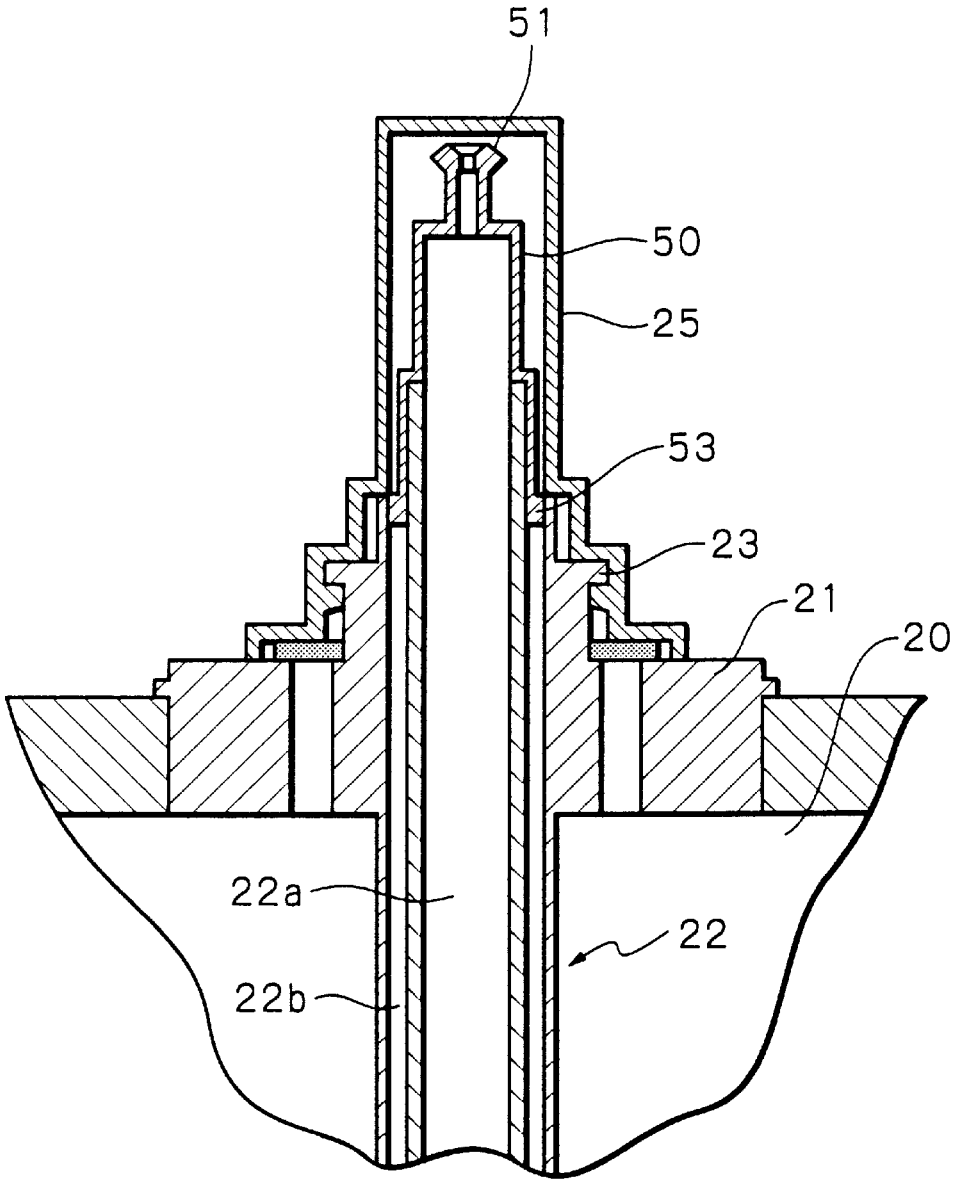
FIG. 12 is a sectional view showing he toner container of the second embodiment in a condition wherein a mouth member is removed.

At a factory, the toner outlet passage 22*a* is used to fill the toner container 20 with toner. As shown in FIGS. 10 and 12, after the toner container 20 has been filled with toner at a factory, a cap 25 is fitted on the screw-threaded part 223 of the support member 221 in place of the mouth member 224, fully sealing the toner container 20. Before the toner container 20 is used at a user's station, the cap 222 is removed and replaced with the mouth member 224. Even when the toner container 20 is accidentally brought down after the removal of the cap 225, the cap member 50 closing the passages 22*a* and 22*b* prevents the toner from flowing out of the container 20.

The operation of the above toner replenishing device will be described hereinafter. First, the lid member 50 closing the passages 22*a* and 22*b* is shifted in order to provide communication between the passages 22*a* and 22*b* and the toner inlet 27 and air inlet 29, respectively. For this purpose, the illustrative embodiment includes an operating member 60.

The operating member 60 is made up of a holder 61 to be positioned on the mouth member 224, a slider 62 and a chuck 64 slidably received in the holder 51, a compression spring 63 constantly biasing the slider 62 downward, and a grip formed integrally with the chuck 64. As shown in FIGS. 9A and 9B, the lid member 50 initially closes the toner outlet passage 22*a* and air inlet passage 22*b*. When the operator pulls the grip 65 upward, it moves the chuck 64 formed integrally with the grip 65 and the slider 62 engaged with the chuck 64. At the same time, the compression spring 63 forces the slider 62 downward to close the chuck 64. As a result, the chuck 64 catches the lug 51 of the lid member 50 and lifts it. When the operator pulls the grip 65 further upward and then turns it by 90 degrees, a lock pin 66 studded on the grip 65 mates with the upper end of the holder 61 and maintains the lid member 50 in its lifted position shown in FIGS. 8A and 8B. In this condition, the opening 52 of the lid member 50 aligns with the toner inlet 27 so as to provide communication between the toner inlet 27 and the toner outlet passage 22*a*. Further, the flange 53 of the lid member 50 is moved away from the air inlet passage 22*b* and provides communication between the air inlet 29 and the air inlet passage 22*b*.

As stated above, the operator can shift the lid member 50 to its open position. This prevents the toner from flying about at the time of replacement of the toner container 20. Seals 56 and 57 seal the mouth member 24 of the toner container 20 while a seal 56 seals the lid member 50. The seals 55–57 obviate the scattering of the toner and thereby promote efficient suction and conveyance of the toner.

To remove the operating member 60 from the toner container 20. the operator turns the grip 65 by 90 degrees in the opposite direction. Consequently, the compression spring 63 returns the slider 62, grip 65 and chuck 64 to the positions shown in FIGS. 9A and 9B. Subsequently, the mouth member 224 is rotated to separate the operating member 20 and toner container 60. Again, the seals 55–57 and lid member 50 prevent the toner from flying out of the toner container 20.

A conventional permeability sensor, net shown, is mounted on a part of the developing unit 10 in order to sense the mixture ratio of the toner and carrier, i.e., the toner content of the developer. When the output of the permeability sensor fails below a preselected value, the powder pump means 40 and air pump are driven to replenish the toner from the toner container 20 to the developing unit 10. The replenishment is interrupted when the toner content of the developer reaches a preselected value.

By the above control, the developing unit 10 is allowed to store a developer having a preselected toner content at all times and perform stable development. Assume that the output of the permeability sensor repeatedly falls below the preselected value a preselected number of times or remains below the same for more than a preselected value. Then, the toner container 20 is determined to be empty. In this case, a message during the operator to replace the toner container 20 appears on, e.g., a display mounted on the body of the image forming apparatus.

The permeability sensor may, of course, be replaced with the density of a toner image formed on the drum 1 and customarily used to control toner replenishment.

The volume of the flexible toner container or sack 20 sequentially decreases due to the discharge of the toner. However, the cylindrical member 222 causes a minimum of, e.g., toner clogging ascribable to the local deformation of the container 20 is occur, so that the entire toner can be discharged from the toner container 20. Moreover, because the bottom of the toner container 20 is tempered downward, the toner successfully fails toward the lower end of the toner outlet passage 22*a* even if its amount is small. The toner can therefore be stably conveyed to the developing unit 10 without regard to its amount.

The toner is conveyed through the toner conveying members (pipe and tube) together with air and therefore substantially free from mechanical stresses. This, coupled with the fact that the conveying members are free from drive loads, maintains the expected property of the toner, insures toner conveyance, and enhances the durability and reliability of the toner replenishing device. In addition, the toner replenishing device is simple in construction and consumes a minimum of power and needs a minimum of cost because of the light drive load.

Moreover, because the toner replenishing device is not arranged on the developing unit 10, the developing unit 10 is extremely simple in configuration. This, coupled with the fact that only the developing sleeve and toner supply screw of the developing unit 10 should be driven, miniaturizes and simplifies the unit 10, reduces the cost of the unit 10, and enhances the reliability, power saving and easy maintenance of the unit 10. In addition, the entire image forming apparatus achieves the various advantages stated above.

Obviously, the toner container 20 can be implemented as a unit independent of the apparatus body because a tube and an electric cable should only be connected to the apparatus body. This further reduces limitations on the size of the toner container 20 to store a great amount of toner, thereby further extending the interval between replacements.

As stated above, the second embodiment achieves the following advantages (1)–(4).

(1) Substantially entire toner stored in the toner container can be surely discharged without any stress acting thereon.

(2) The toner can be surely discharged from the toner container in a preselected amount at a time despite its low fluidity.

(3) The toner can be surely conveyed without having its property or quality changed even when the toner container is remote from the developing unit.

(4) A single toner nozzle sufficient both the discharge of toner and the entry of air.

Third Embodiment

Figure 13:
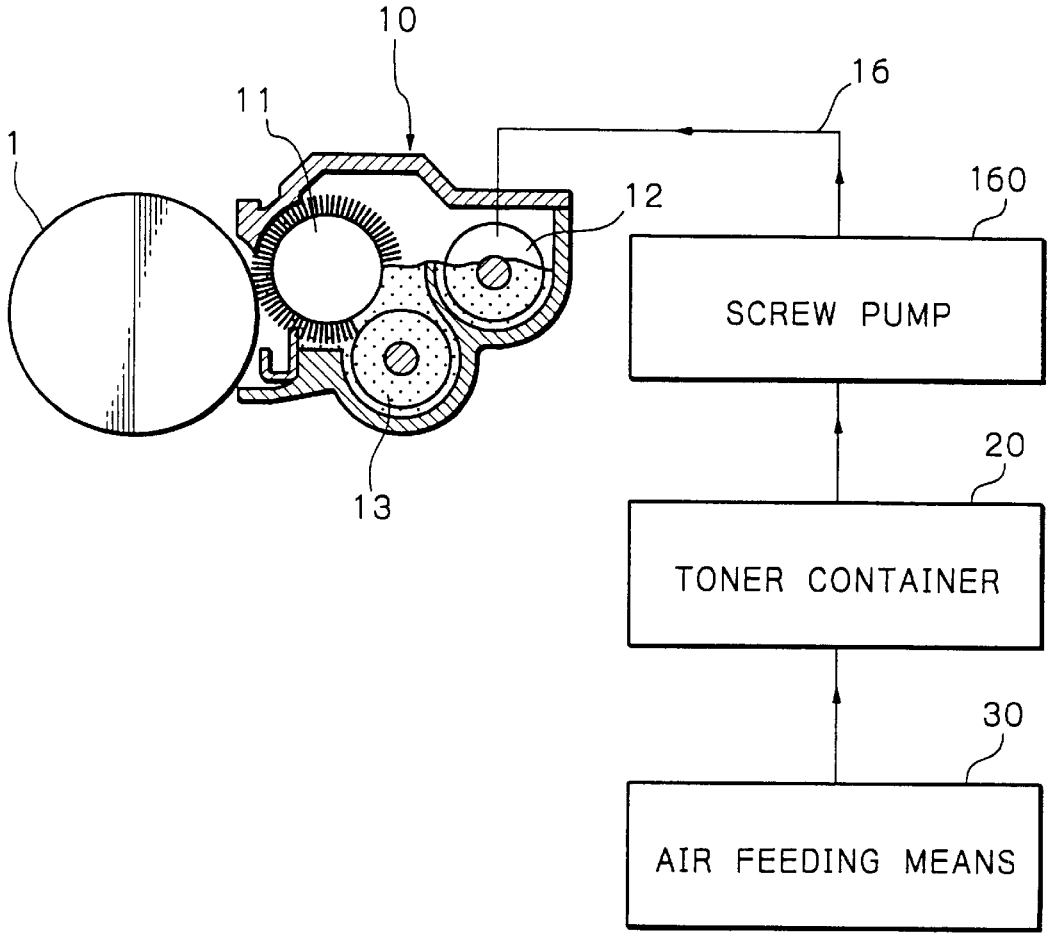
FIG. 13 is a schematic block diagram showing a third embodiment of the developer container in accordance with the present invention.

Referring to FIG. 13, a third embodiment of the present invention will be described. As shown, a developer replenishing device includes the air feeding means 30, the toner container or developer container 20 filled with toner, and a screw pump or toner conveying means 60 for conveying the toner from the container 20 to the developing unit 10. The developing unit 10 is substantially identical in construction with the developing unit 10 shown in FIGS. 1 and 2.

The toner container 20 is a unit independent of the developing unit 10 and set at suitable position on the apparatus body. The flexible tube 16 communicates the toner container 20 to the developing unit 10. The tube 16 may be formed of the same material as described in relation to the first embodiment.

Figure 14A:
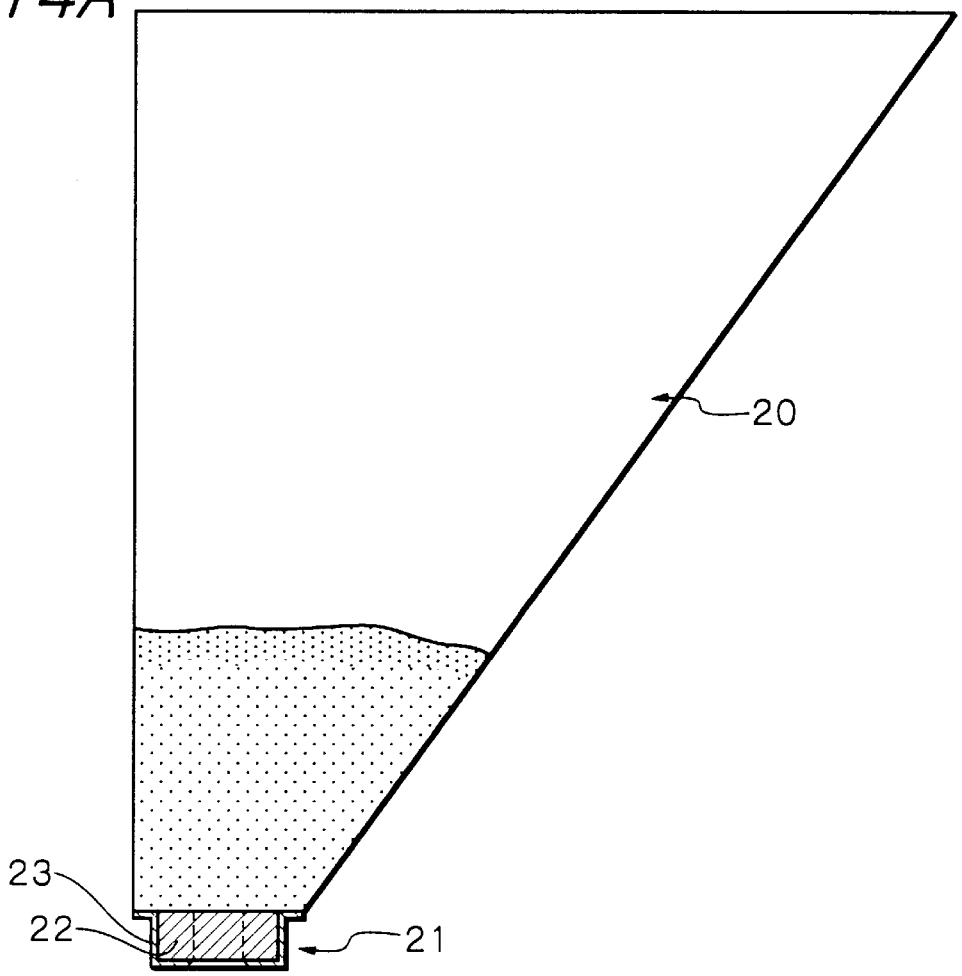
FIGS. 14A and 14B are respectively a sectional view and a bottom view showing a toner container included in the third embodiment.
Figure 14B:
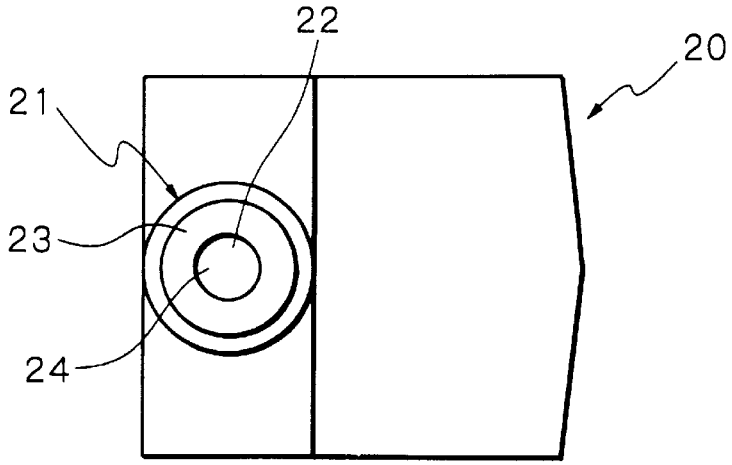

As shown in FIGS. 14A and 14B, the toner container 20 is implemented as a sealed box having six faces. The front face and rear face of the container or box 20 each have a trapezoidal configuration tapering downward. The container 20 is formed of polyethylene, nylon or similar resin or paper. A seal valve 21 is fitted on the bottom of the container 20 and made up of a valve body 322 formed of foam sponge or similar elastic material and a member 323 affixing the valve body 322 to the container 20. As shown in FIG. 14B, a cruciform slit 24 having a small width is formed throughout the center of the valve body 22.

The container 20 may be implemented by a hard case formed of resin. In the illustrative embodiment, the container 20 is constituted by one or more flexible sheets of paper or resin each being 80 $\mu$m to 200 $\mu$m thick. Aluminum may advantageously be deposited on the front or the rear of each sheet from the static electricity and humidity standpoint.

The flexible toner container or box 20 is not bulky, compared to a conventional hard case, and is easy to handle at the time of transport or storage while occupying a minimum of space. When the toner container 20 is collected from the user's station to be recycled, reused or burned up, it can be folded up due to its flexibility. This not only further enhances the above advantages, but also noticeably reduces the circulation cost from the user's station to, e.g., the recycling cite. The toner container 20 and semi valve 321 may advantageously be formed of the same material for facilitating recycling.

Figure 15:
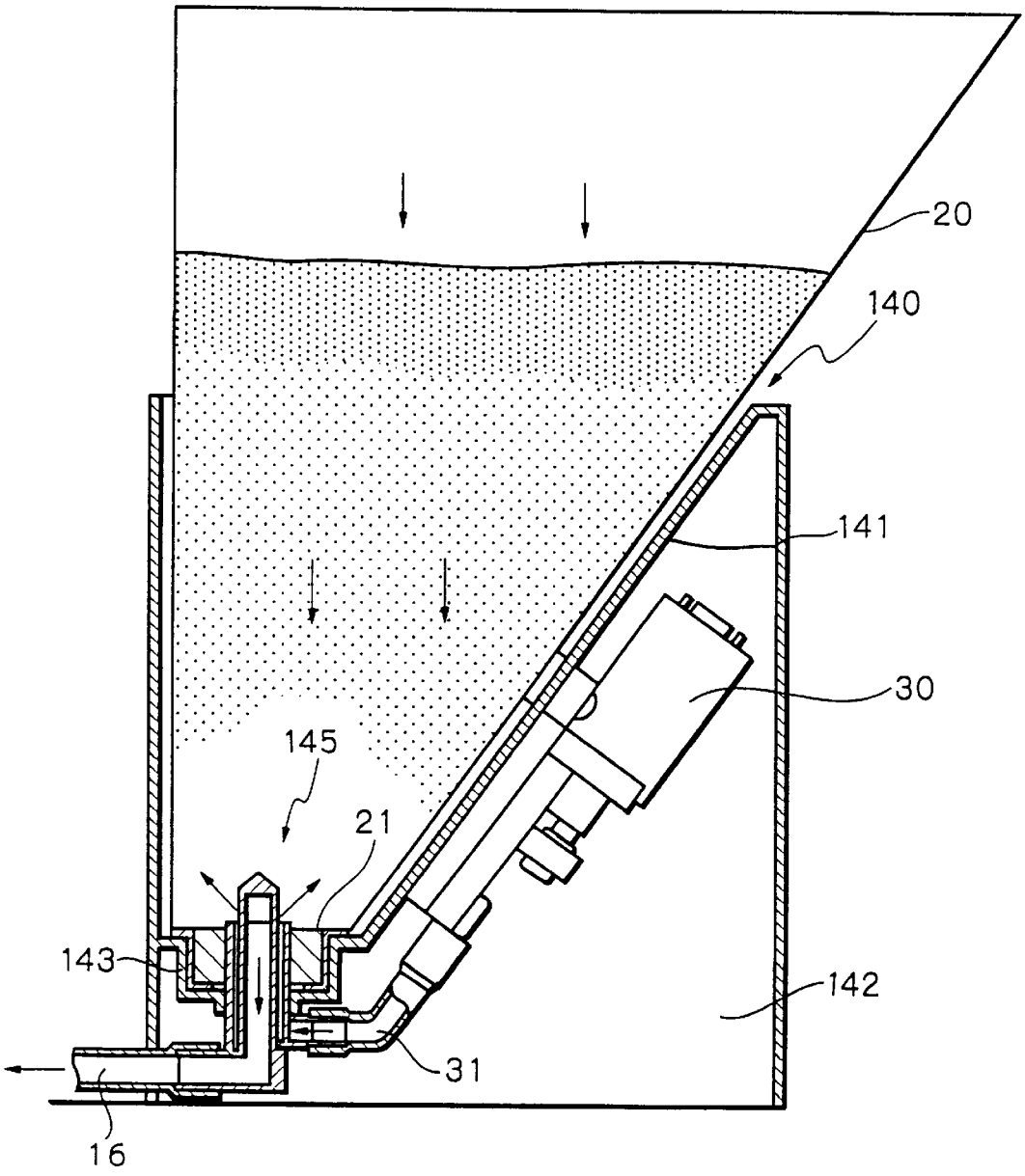
FIG. 15 is a sectional view showing the toner container of the third embodiment in a set condition.

FIG. 15 shows the toner container mounted to the apparatus body. As shown, the apparatus body includes a portion 140 for setting the container 20 in an upright position shown in FIG. 14A. The portion 140 may be located at a position inside of the apparatus, but accessible when a door or a cover included in the apparatus body is opened, or a position exposed to the outside of the apparatus. The portion 140 includes a support frame 141 for receiving the container 20 via its upper end. The support frame 141 and a frame 142 included in the apparatus body form a space corresponding in shape to the container 20. A recess 143 is formed in the bottom of the portion 40 for receiving the seal valve 321. A cylindrical nozzle or projection member 145 protrudes upward from the center of the bottom of the recess 143.

Figure 16:
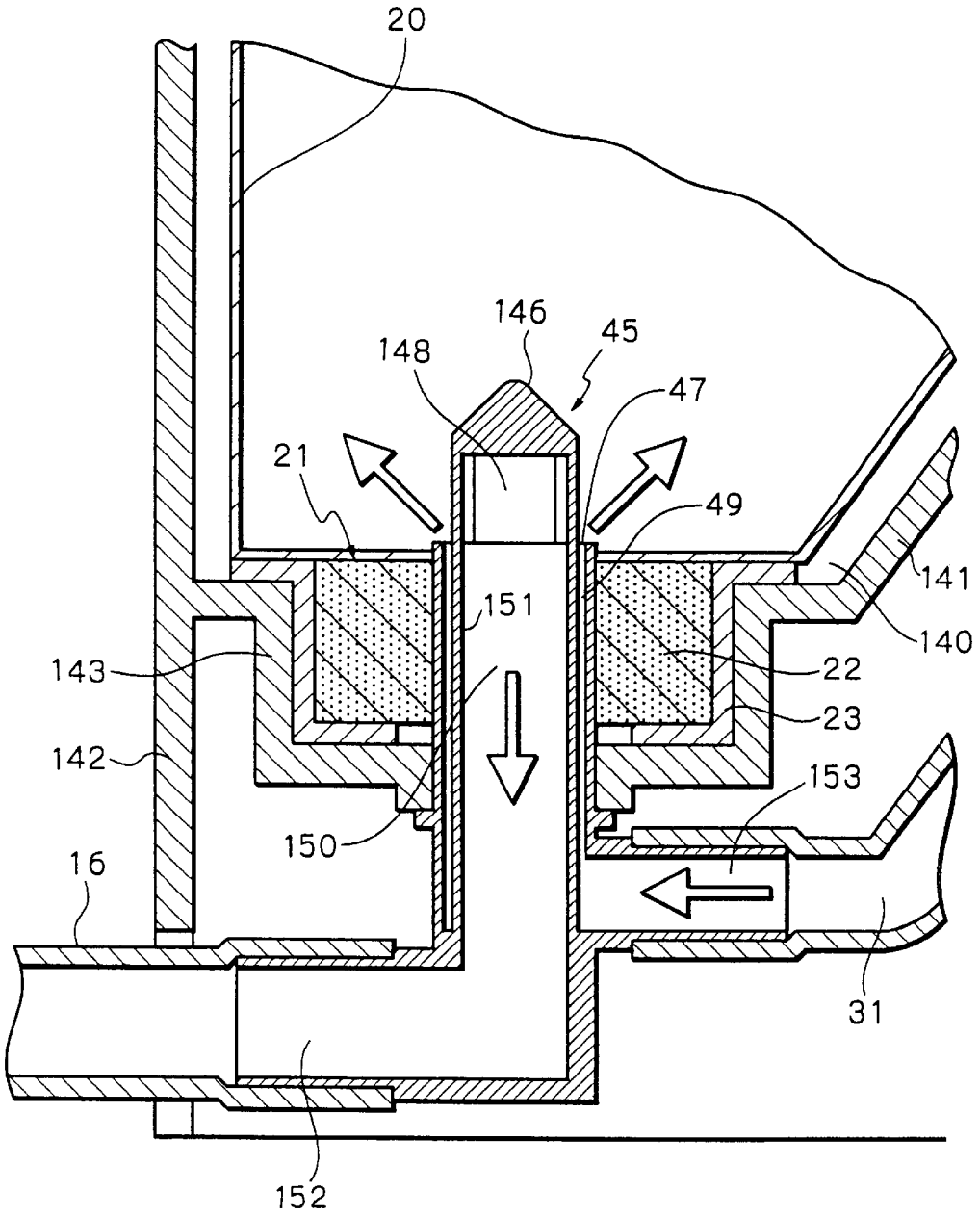
FIG. 16 is a fragmentary enlarged sectional view showing essential part of the third embodiment in the condition of FIG. 15.

As best shown in FIG. 16, the nozzle 145 has a conical tip 146 at its upper end. An air inlet port 47 and a toner outlet port 149 are positioned substantially at the same level or height each other. A wall 151 forms in the nozzle body 145 an air inlet passage 49 and a toner outlet passage 150 communicated to the air inlet port 47 and toner outlet port 148, respectively. The toner outlet passage 150 is extended to the lower end of the nozzle 145 and then bent leftward, as viewed in FIG. 16, so as to merge into a connection port 152. The air inlet passage 49 is bent rightward, as viewed in FIG. 16, at a higher level than the toner outlet passage 150 and merges into a connection port 153. The tube 16 is connected to the connection port 152. An air pump 30 serving as toner conveying means at the same time is connected to the connection port 53 by a pipe 31.

When the toner container 20 is set on the portion 140 of the apparatus body, the nozzle 145 pierces the body 322 of the seal valve 321 through the cruciform slit 324. At this instant, the tip 146 of the nozzle 145 can smoothly enter the container 20 because the valve body 322 is formed of an elastic material. In this condition, the air inlet port 47 and toner outlet port 148 are positioned slightly above the bottom of the container 20.

Figure 18:
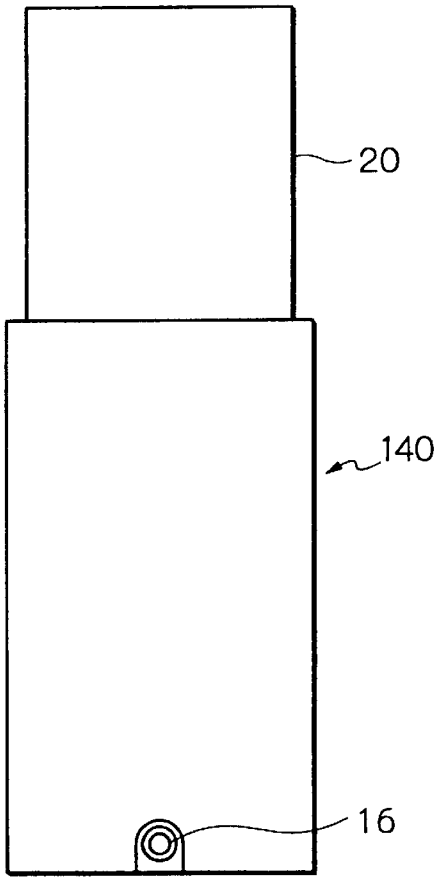
FIGS. 17 and 18 are respectively a front view and a side elevation showing the toner container of the third embodiment in the set condition.
Figure 17:
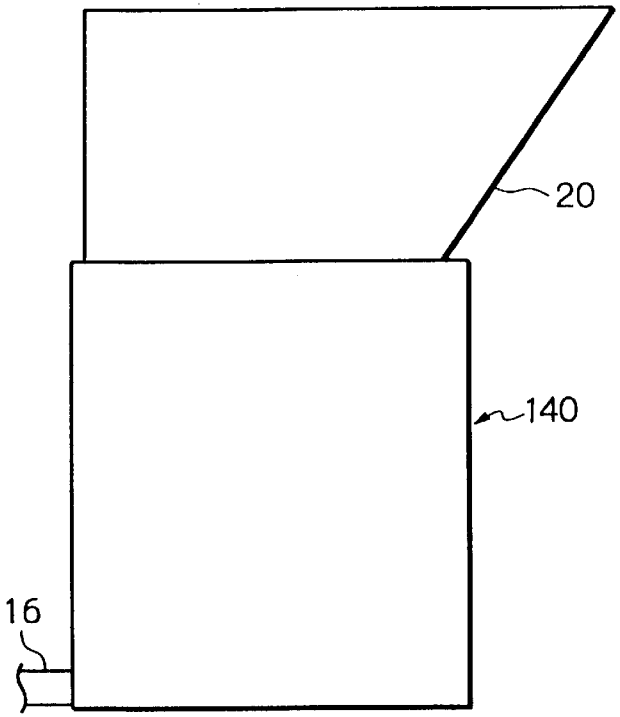

As stated above, only if the operator drops the container 20 into the portion 140 of the apparatus body, the nozzle 145 enters the container 20 as far as a preselected position by opening the seal valve 321. As a result, the container 20 is set on the apparatus body, as shown in FIGS. 17 and 18.

In operation, when the air pump 30 is energized by a toner replenish signal, it sends compressed air into the toner container 20 via the pipe 31, air inlet passage 49 and air inlet port 47. Because the compressed air jets into the container 20 in the vicinity of the bottom of the container 20, it scatters and fluidizes the toner layer existing in the container 20 while flowing upward. The continuous feed of the compressed air raises air pressure inside the toner container 20. As a result, the toner is discharged from the toner container 20 via the toner outlet port 48, toner outlet passage 60 and tube 16 due to the air pressure and its own weight. The toner discharged from the toner container 20 is conveyed to the developing unit 10 together with air.

As stated above, the toner stored in the toner container 20 is transferred to the developing unit 10 by the air pressure. Air jetting into the toner container 20 fluidizes the toner and thereby promotes the smooth and sure conveyance of the toner. In addition, the toner container 20 is funnel-shaped tapered toward the nozzle 45, allowing substantially the entire toner to be discharged. Air flowing into the developing unit 10 together with the toner is discharged via the filter 17, so that the toner is prevented from flying about.

The toner being transferred by the air pressure is free from mechanical stresses and is protected from blocking or bridging because of sufficient fluidity. Moreover, the toner transfer using the air pressure maintains the physical property of the toner stable without regard to the amount of toner existing in the toner container 20 and allows the entire toner to be discharged from the container 20.

Experiments conducted with the illustrative embodiment showed the same results as described with reference to FIG. 4.

Generally, toner should sometimes be replenished to a developing unit rapidly in a great amount, as with an image forming apparatus of the type performing high-speed printing or copying or broad width printing or copying, or should sometimes only be fed in a small amount. The toner replenishing device shown in FIG. 15 can meet such various demands only if the static pressure and discharged of the air pump 30 are suitably selected up to the maximum values available with the air pump 30. In addition, the maximum flow rate of the air pump 30 is as low as 2.0 l/min in an unloaded condition, so that air can be easily discharged in, e.g., the developing device so as to prevent the toner from flying about.

Figure 19:
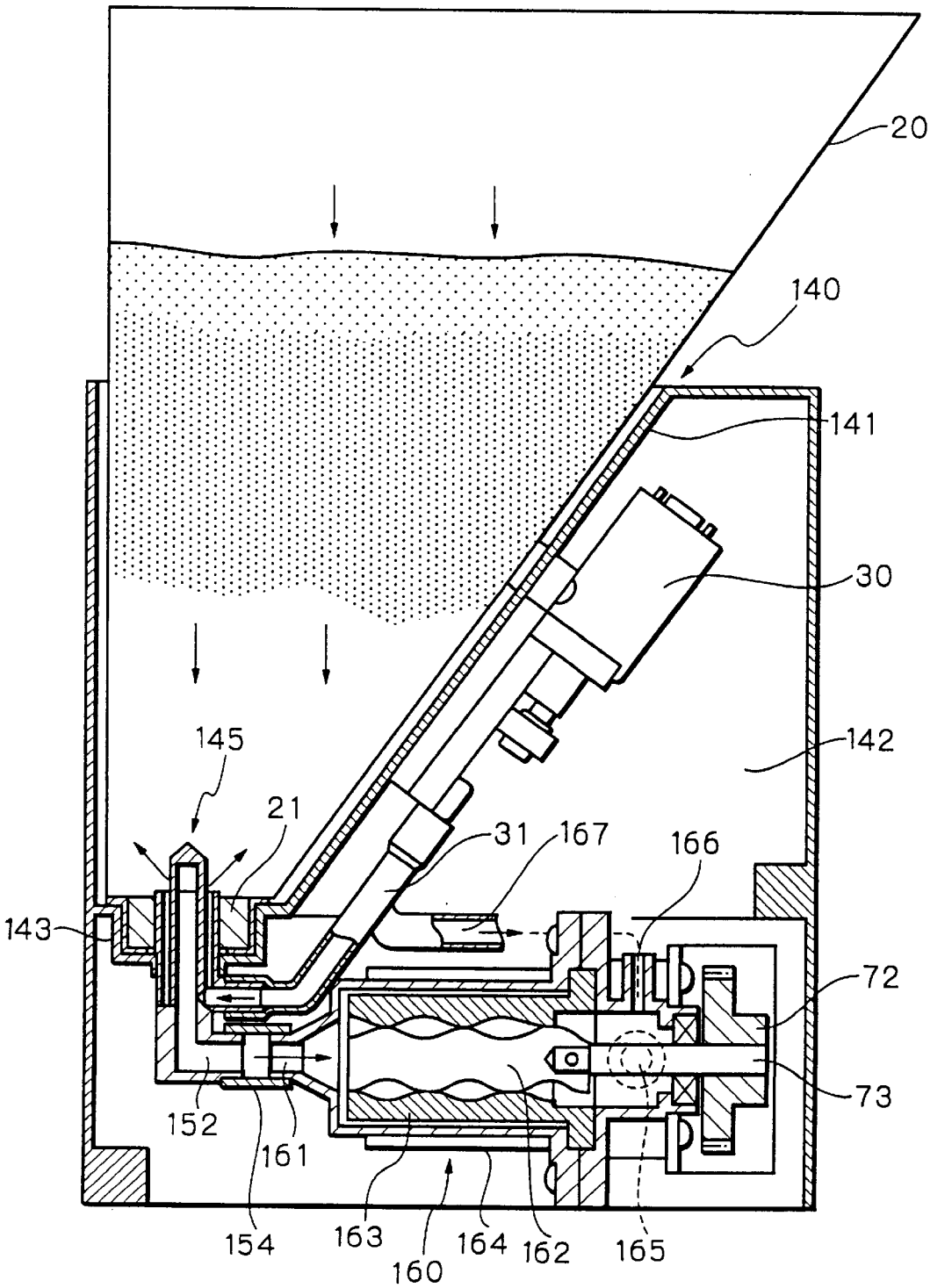
FIG. 19 is a sectional view showing a modification of the third embodiment.
Figure 20:
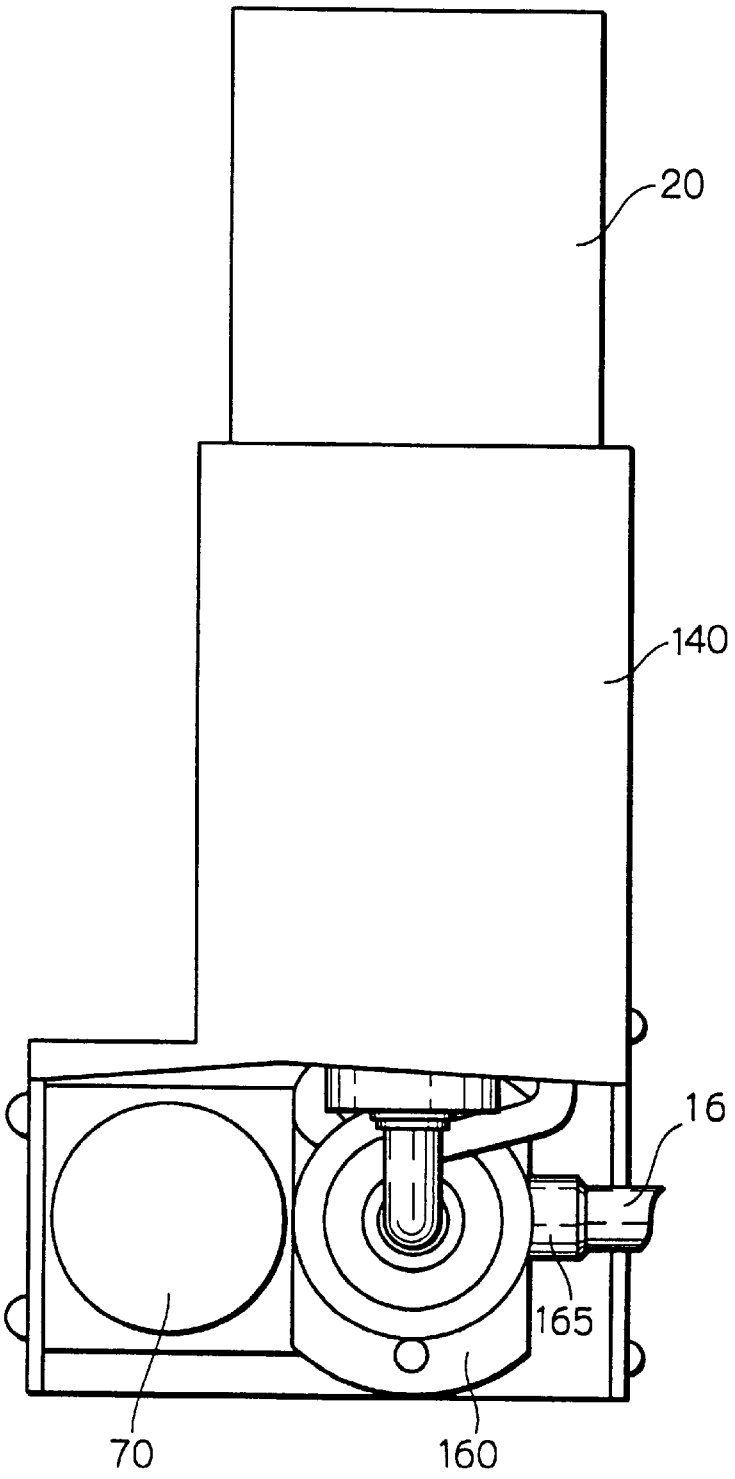
FIGS. 20 and 21 are respectively a front view and a rear view associated with FIG. 19.
Figure 21:
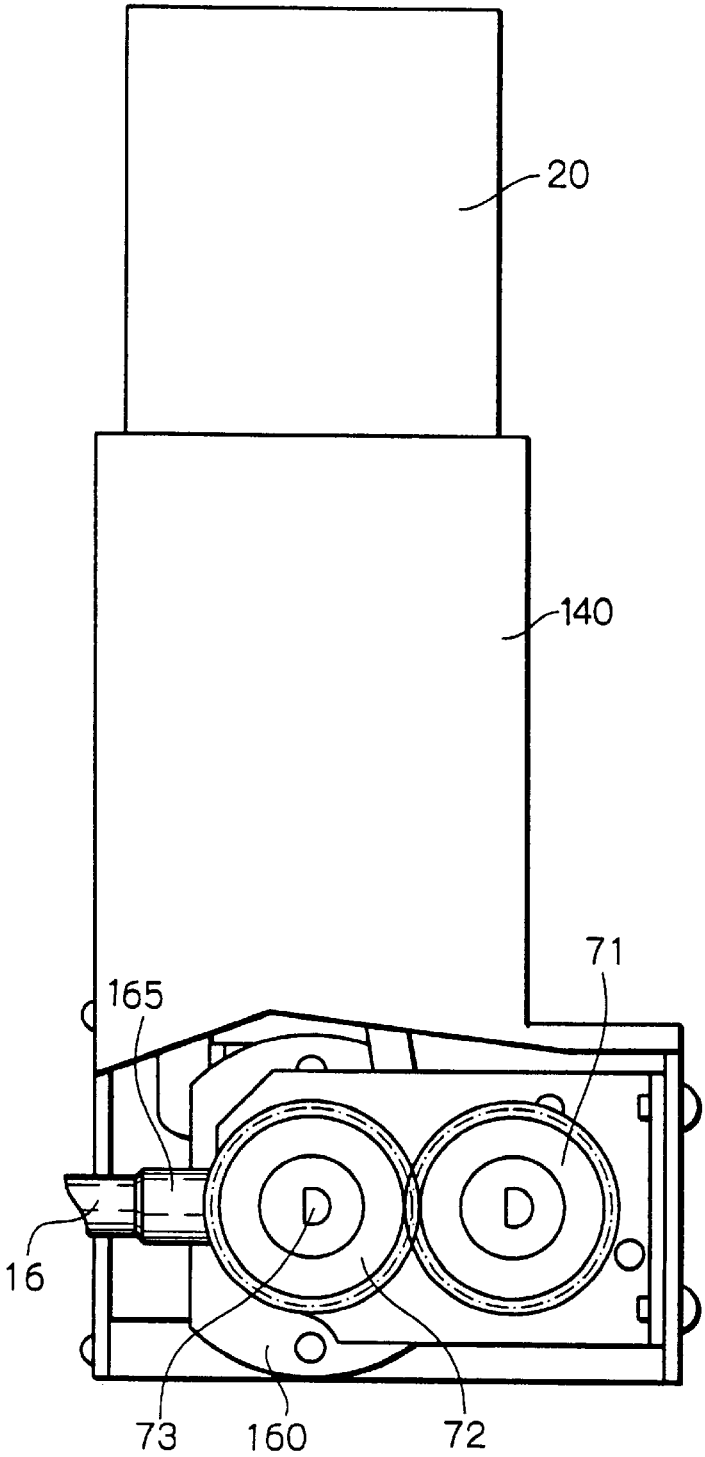

FIG. 19 shows a modification of the third embodiment. As shown, the modification uses a conventional suction type single axis, eccentric screw pump as the air feeding means 160. FIGS. 20 and 21 show the toner replenishing device of FIG. 19 in side elevations.

As shown in FIG. 19, the screw pump 160 includes a suction port 161 to which the connection port 152 is communicated by a pipe 154. The screw pump 161 is generally made up of an eccentric screw-shaped rotor 162 formed of metal or similar rigid material, a double screw-thread type stator 163 formed of rubber or similar elastic material, and a holder 163 surrounding the rotor 162 and stator 163 and formed of resin or similar material. The stator 163 is affixed to the holder 164. A drive motor 70 causes the rotor 162 to rotate via gears 71 and 72 and a drive shaft 73.

The screw pump 160 has an air inlet portion 166 at its toner discharge side. The air inlet portion 166 is communicated to the air pump 30 by a pipe 167. Air fed under pressure from the air pump 30 fluidizes the toner to be fed to the developing unit and thereby insures the conveyance by the screw pump 160. While the screw pump 160 is driven by the exclusive drive motor 70, it may be driven by a main motor, not shown, included in the image forming apparatus via a clutch not shown.

The modification is also provided with the configuration shown in FIG. 1. When the air pump 30 is operated, as in the illustrative embodiment of FIG. 15, compressed air is fed from the air pump to the toner container 20 and fluidizes the toner layer in the container 20. At the same time, the toner is driven out of the container via the nozzle 145 due to the air pressure and the suction of the screw pump 160. Subsequently, the toner is conveyed by the screw pump 160 to the toner inlet 14 via the toner discharge portion 165 and tube 16.

The screw pump 160 is capable of continuously conveying the toner at a constant rate with a high gas ratio in proportion to the rotation speed of the rotor 162, as well known in the art. It is therefore possible to control the amount of toner to be conveyed by controlling the duration of drive of the powder pump 160, it is to be noted that the screw pump means 160 should preferably be constructed into a unit for facilitating production and maintenance.

A conventional permeability sensor, not shown, is mounted on a part of the developing unit 10 in order to sense the mixture ratio of the toner and carrier. When the output of the permeability sensor falls below a preselected value, the screw pump means 160 and air pump 30 are driven to replenish the toner from the toner container 20 to the developing unit 10. The replenishment is interrupted when the toner content of the developer reaches a preselected value.

By the above control, the developing unit 10 is allowed to store a developer having a preselected toner content at all times and perform stable development. Assure that the output of the permeability sensor repeatedly falls below the preselected value a preselected number of times or remains below the same for more than a preselected value. Then, the toner container 20 is determined to be empty. In this case, a message urging the operator to replace the toner container 20 appears on, e.g., a display mounted on the body of the image forming apparatus.

Again, the permeability sensor may be replaced with the density of a toner image formed on the drum 1 and customarily used to control toner replenishment.

The maximum flow rate of the air pump 30 in an unloaded condition is as low as 2.0 l/min. This allows to be easily discharged in, e.g., the developing unit and thereby easily prevents the toner from flying about.

To insure reliable toner conveyance by the screwed pump 160, the time for feeding air from the air pump 30 is important. It is necessary that compressed air begins to be fed before the screw pump 161 is driven. This insures stable toner transfer while preventing the toner from remaining in, e.g., the tube 16.

Figure 22:
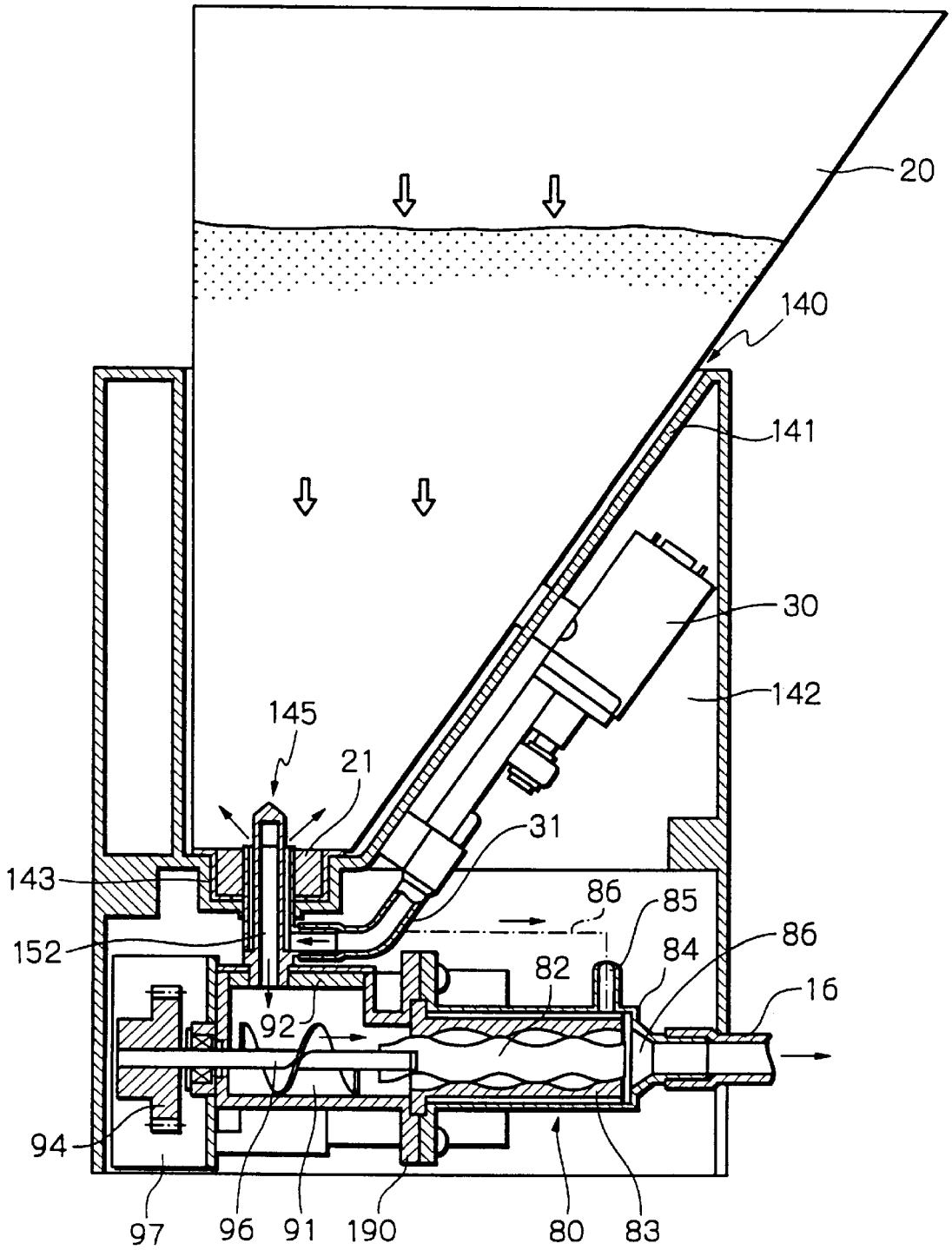
FIG. 22 is a sectional view showing another modification of the third embodiment.
Figure 23:
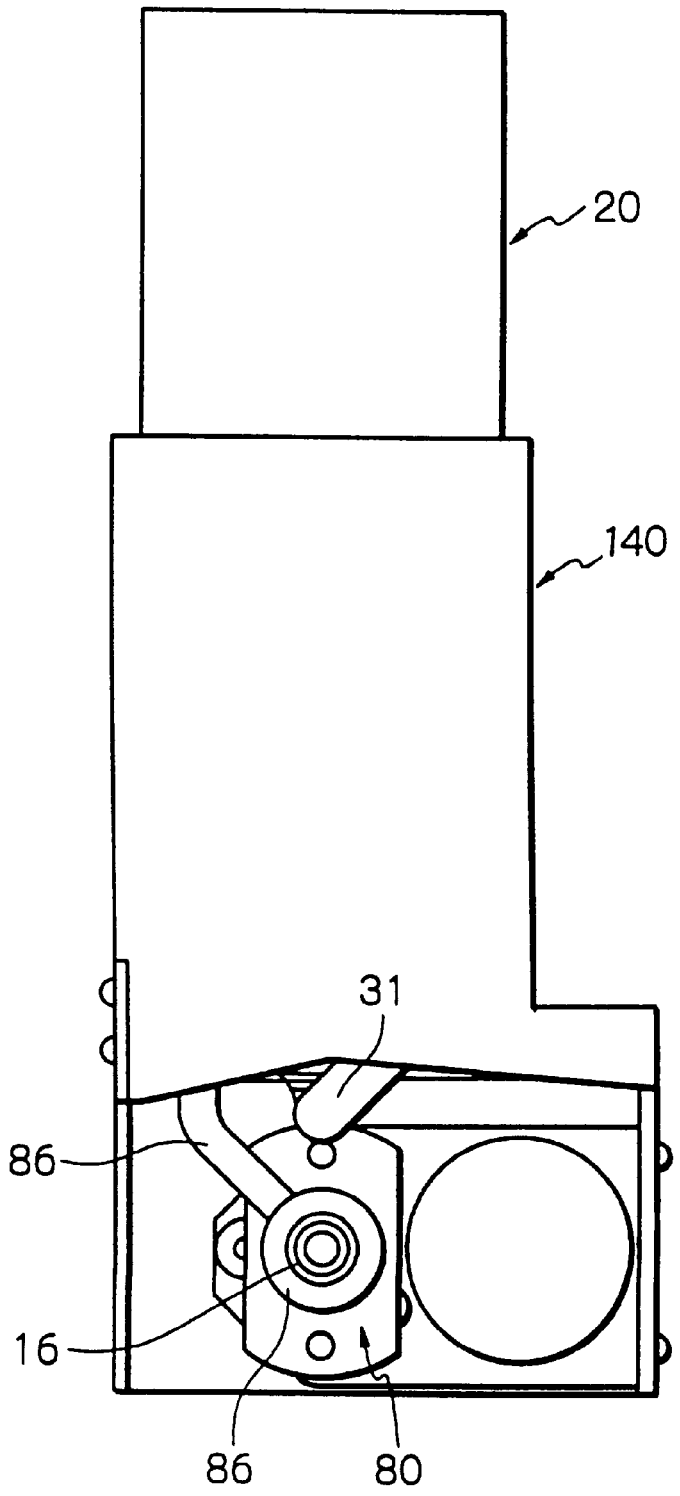
FIGS. 23 and 24 are respectively a front view and a rear view showing the modification of FIG. 22.
Figure 24:
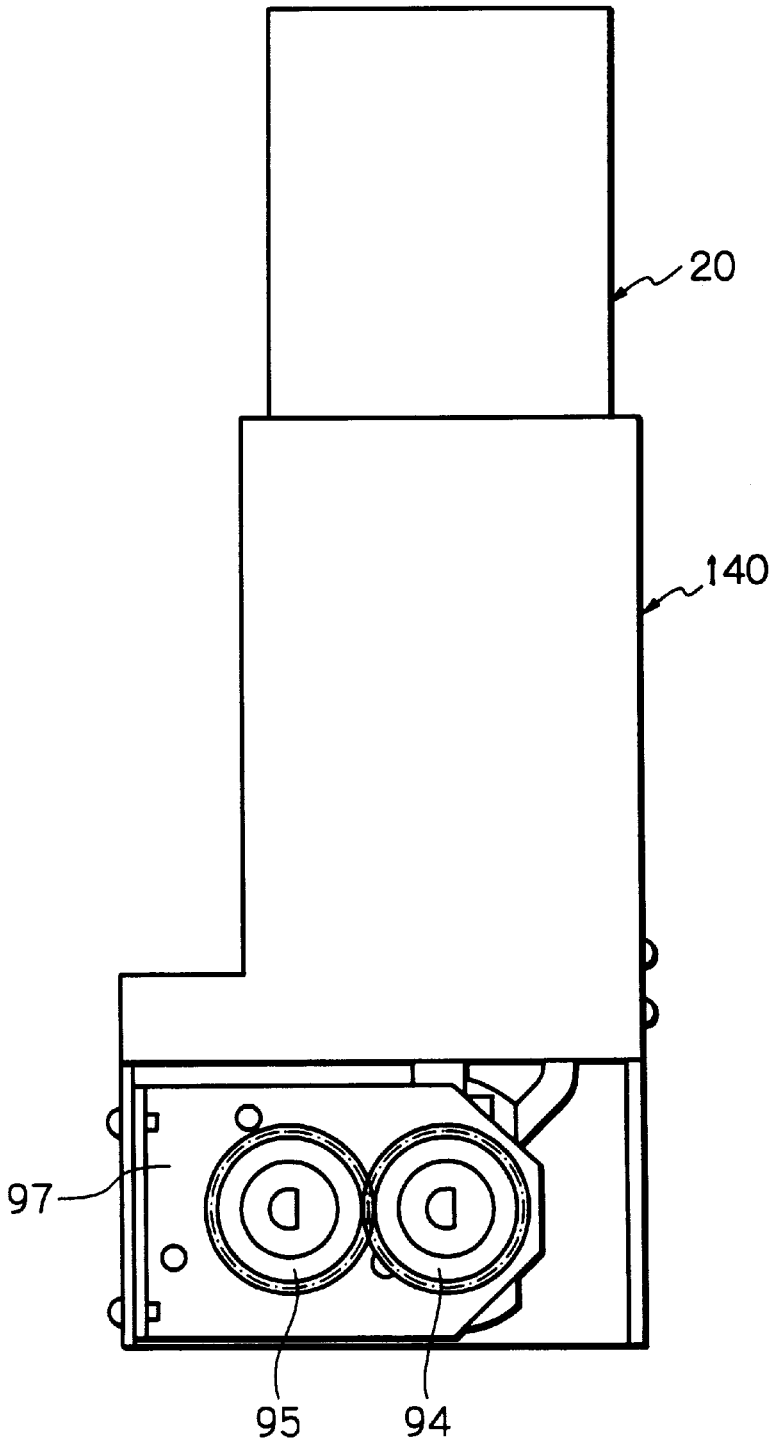
Figure 16:
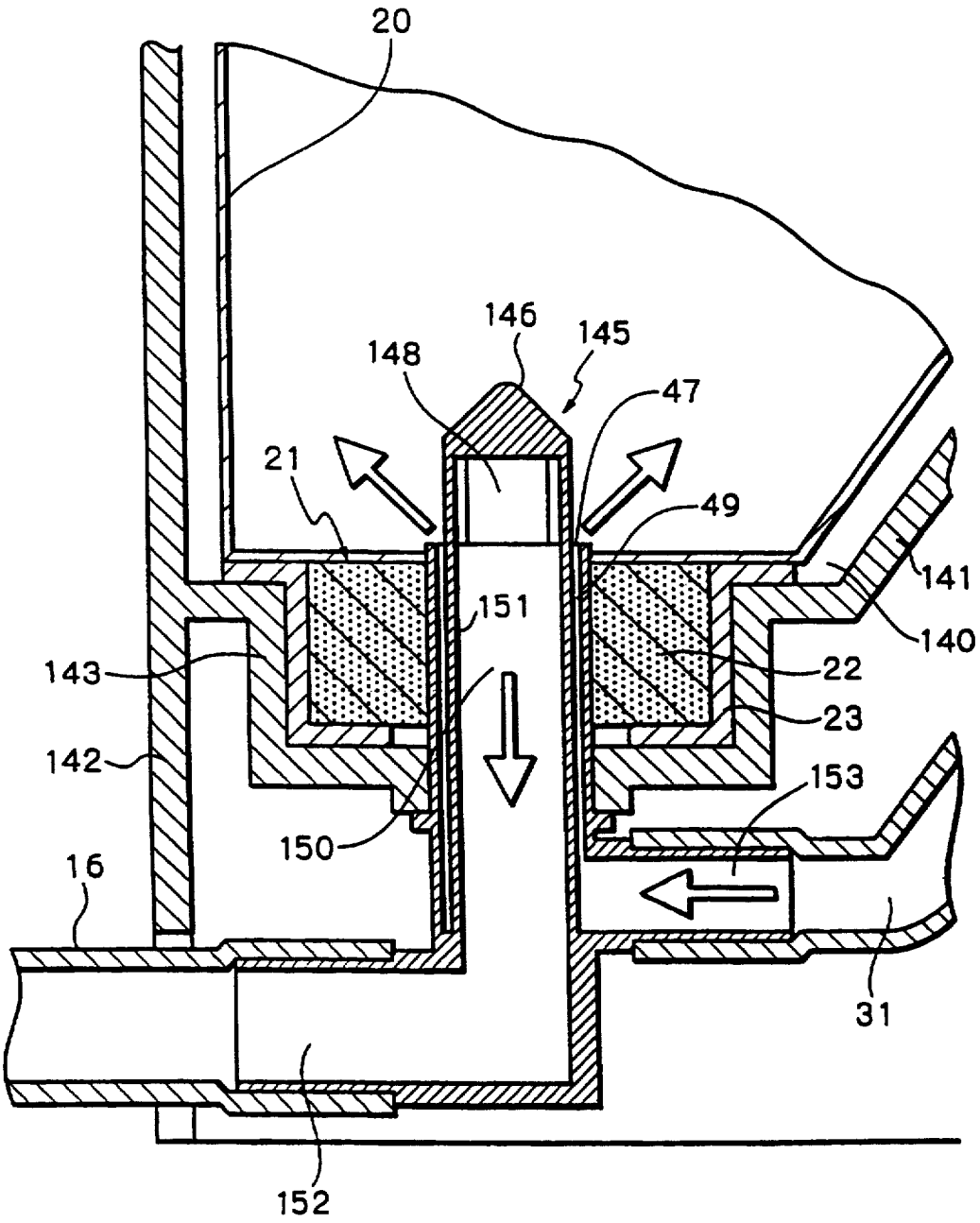

FIG. 22 shows another modification of the third embodiment. As shown, the modification uses a discharge type, single axis eccentric screw pump 80. FIGS. 23 and 24 show the toner replenishing device of FIG. 22 in side elevation.

As shown in FIG. 22, the screw pump 80 is supported by a pump support member 90. The connection port 152 is connected to the pump support 90. The pump support member 90 includes a toner inlet portion 91 for receiving the toner sent from the connection portion 152 together with air. An air filter or air discharging means 92 forms a part, e.g., the upper portion of the pump support member 90.

The discharge type screw pump 80 is generally made up of an eccentric screw-shaped rotor 82 formed of metal, plastics or similar rigid material, a stator 83 formed of rubber or similar elastic material, and a holder 84 surrounding the rotor 82 and stator 83 and formed of resin or similar material. The stator 83 is affixed to the holder 84. A drive motor 190 (see FIG. 23) causes the rotor 82 to rotate via gears 94 and 95 and a drive shaft 96. The drive shaft 96 is positioned in the toner inlet portion 91 and implemented as a screw for conveying the toner from the toner inlet portion 91 to the screw pump 80. The screw pump 80 is affixed to the apparatus body via a bracket 97.

The holder 84 of the discharge type screw pump 80 is formed with an air inlet 85 and a toner outlet 86. The air pump 30 is connected to the air inlet 85 by the pipe 67. While the screw pump 80 is also driven by an exclusive drive motor, it may be driven by a main motor, now shown, included in the image forming apparatus via a clutch not shown.

When the air pump 30 is operated, as in the illustrative embodiment of FIG. 15, compressed air is fed from the air pump 30 to the toner container 20 and fluidizes the toner layer in the container 20. At the same time, the toner is driven out of the container 20 via the nozzle 145 due to the air pressure. Subsequently, the toner is transferred to the toner inlet portion 91 via the connection port 152. When a drive motor 93 is energized, it drives the drive shaft 96 and causes it to convey the toner toward the screw pump 80. At the same time, the rotor 82 is caused to rotate to discharge the toner via the outlet port 86. At the same time as or slightly before the start of operation of the screw pump 80, the air pump 30 starts feeding compressed air to the screw pump 80. As a result, the toner is transferred from the screw pump 80 to the toner inlet 14 of the developing unit together with air via the tube 16.

The discharge type screw pump 80 is also capable of continuously conveying the toner at a constant rate with a high solid-to-gas ratio in proportion to the rotation speed of the rotor 82, as well known in the art. It is therefore possible to control the amount of toner to be conveyed by controlling the duration of drive of the screw pump 80. It is to be noted that the excess part of air entered the toner inlet portion 91 together with the air is discharged via the air filter 92.

Generally, toner for use in an electrophotographic image forming apparatus lacks fluidity and is difficult to convey, as stated earlier. In the illustrative embodiment, the toner is conveyed through the toner conveying members (pipe and tube) together with air and therefore substantially free from mechanical stresses. This, coupled with the fact that the conveying members are free from drive loads, maintains the expected property of the toner, insures toner conveyance, and enhances the durability and reliability of the toner replenishing device. In addition, the toner replenishing device is simple in construction and consumes a minimum of power and needs a minimum of cost because of the light drive load.

Because the flexible tube should only be connected to the developing unit 10, toner is prevented from flying about. In addition, because the toner replenishing device may be located at any position relative to the developing unit 10, a position where the operator can replace the toner container 20 most easily can be selected.

Moreover, the toner container 20 needs only the simple self-closing valve and is therefore simple in configuration and easy to replace while preventing the toner from being scattered. In addition, the container 20 allows a minimum of toner to remain therein and is therefore economical and can be dealt with safety and hygienically.

As stated above, the third embodiment allows the toner container 20 to be extremely easily replaced, conveys the toner form the container to the developing unit surely and stably, and obviates toner scattering and contamination at the time of replacement of the container.

Various modifications will become possible for those skilled in the art after receiving the teachings of the present disclosure without departing from the scope thereof.

What is claimed is:

1. An imaged forming apparatus capable of fluidizing a developer and then conveying said developer to a preselected location, said image forming apparatus comprising:

a developer container storing the developer, said developer container including an air inlet portion for allowing compressed air into said developer container and a developer outlet portion for discharging the developer from said developer container;

air feeding means for feeding compressed air into said developer container for fluidizing the development; and developing conveying means for conveying the developer fluidized from said developer container, said developer conveying means including sucking means for sucking the developer, said sucking means having an eccentric powder suction pump with a single shaft.

2. An apparatus as claimed in claim 1, wherein said developer outlet portion is positioned in the lower portion of said developer container in the direction of gravity.

3. An apparatus as claimed in claim 1, wherein said air feeding means communicate with said air inlet portion.

4. An apparatus as claimed in claim 1, wherein said air feeding means control an amount of the developer to be conveyed to the preselected location.

5. An apparatus as claimed in claim 1, wherein said developer container further comprises a discharge portion for discharging the compressed air conveyed together with the developer.

6. An apparatus as claimed in claim 1, wherein said developer container comprises a sack formed of a flexible material.

7. An apparatus as claimed in claim 1, wherein said developer container has two chambers communicated to each other at a lower portion of said developer container in the direction of gravity, said air inlet portion being formed in a non-communicated portion of one of said two chambers.

8. An apparatus as claimed in claim 1, wherein said developer container further comprises a connecting member formed with said air inlet portion and said developer outlet portion.

9. An apparatus as claimed in claim 1, further comprising the developer conveying means communicated to said developer outlet portion and the preselected location.

10. An apparatus as claimed in claim 1, wherein said air feeding means comprises an air pump having a maximum static pressure of 18 Kpa to 50 Kpa and a maximum flow rate of 2.0 l/min.

11. An apparatus as claimed in claim 1, wherein the developer comprises either toner or a toner and carrier mixture.

12. An apparatus as claimed in claim 1, wherein said air feeding means feed the compressed air via a position of said powder pump just after an outlet.

13. A developer conveying device comprising:

a developer container storing a developer, said developer container including an air inlet portion for allowing compressed air into said developer container and a developer outlet portion for discharging the developer from said developer container, said air inlet portion being positioned in a lower portion of said developer container in a direction of gravity;

air feeding means for feeding compressed air into said developer container to fluidize the developer;

developer discharging means for discharging the developer fluidized from said developer container; and developer moving means for causing the developer discharged from said developer container to move to a preselected location.

14. An device as claimed in claim 13, wherein said developer discharging means comprise sucking means for sucking the developer.

15. An device as claimed in claim 14, wherein said sucking means comprise a suction type single axis, eccentric powder pum, said powder pump serving as sucking means of said developer moving means also.

16. An device as claimed in claim 15, wherein said air feeding means feed the compressed air via a position of said powder pump just after an outlet.

17. An device as claimed in claim 13, wherein said developer moving means comprise sucking means for sucking the developer.

18. An device as claimed in claim 13, wherein said developer moving means cause the compressed air to flow in a direction in which the developer should be moved.

19. An device as claimed in claim 13, wherein the developer comprises either toner or a toner and carrier mixture.

20. An image forming apparatus comprising:

a developer container storing a developer, said developer container including an air inlet portion for allowing compressed air into said developer container and a developer outlet portion for discharging the developer container, said air inlet position being positioned in a lower portion of said developer container in a direction of gravity;

air feeding means for feeding compressed air into said developer container to fluidize the developer;

developer discharging means for discharging the developer fluidized from said developer container; and developer moving means for moving the developer discharged from said developer container to a developing unit.

21. An apparatus as claimed in claim 20, further comprising a nozzle for allowing the compressed air into said developer container and discharging the developer from said developer container.

22. An apparatus as claimed in claim 20, wherein the developer comprises either toner or a toner and carrier mixture.

23. An image forming apparatus capable of replenishing a developer stored in a developer container to a developing unit, said image forming apparatus comprising:

a body to which the developer container is removably mounted; and an air feed portion capable of penetrating into the developer container when said developer container is mounted to said body, said air feed portion comprising a projection member capable of entering the developer container when said developer container is mounted to said body and leaving said developer container when said developer container is removed from said body.

24. An apparatus as claimed in claim 23, further comprising a developer outlet portion for discharging the developer from said developer container.

25. An apparatus as claimed in claim 23, wherein said projection member is formed with an air passage for feeding the compressed air and a developer passage for discharging the developer.

26. An apparatus as claimed in claim 23, wherein said developer container comprises a sealed container.

27. An apparatus as claimed in claim 23, wherein the developer comprises either toner or a toner and carrier mixture.

28. An image forming apparatus capable of replenishing a developer stored in a developer container to a developing unit, said image forming apparatus comprising:

a body to which the developer container is removably mounted; and an air feed portion capable of penetrating into the developer container when said developer container is mounted to said body, the developer container comprising a sealed container including a valve.

29. An apparatus as claimed in claim 28, wherein said valve opens when a projection member protruding from said body is inserted into said valve and closes when said projection member is released from said valve.

30. An image forming apparatus capable of replenishing a developer stored in a developer carrier to a developing unit, said image forming apparatus comprising:

a body to which the developer container having a valve is removably mounted;

discharging means for feeding compressed air into the developer container to discharge the developer from said developer container; and developer conveying means for conveying the developer discharged from the developer container to the developing unit.

31. An apparatus as claimed in claim 30, wherein said developer conveying means convey the developer by sucking said developer.

32. An apparatus as claimed in claim 30, wherein said developer conveying means comprise a suction type single axis, eccentric screw pump.

33. An apparatus as claimed in claim 30, wherein said developer conveying means convey the developer by discharging.

34. An apparatus as claimed in claim 30, wherein said developer means comprise a discharge type single axis, eccentric screw pump.

35. An apparatus as claimed in claim 30, further comprising air discharging means for discharging the compressed air fed into the developer container to an outside of a developer conveying path.

36. An apparatus as claimed in claim 30, wherein said developer container comprise a sealed container.

37. An apparatus as claimed in claim 30, wherein said valve opens when a projection member protruding from said body is inserted into said valve and closes when said projection member is released from said valve.

38. An apparatus as claimed in claim 30, wherein said developer comprises either toner or a toner and carrier mixture.

* * * * *

UNITED STATES PATENT AND TRADEMARK OFFICE

CERTIFICATE OF CORRECTION

PATENT NO. : 6,201,941 B1
DATED : March 13, 2001
INVENTOR(S) : Nobuo Kasahara, et al It is certified that error appears in the above-identified patent and that said Letters Patent is hereby corrected as shown below:

Drawing sheet,
Please substitute Fig. 16 with the attached Fig. 16 to correct reference number "45" -- 145 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*